United States Patent [19]

Edwards

[11] Patent Number: 5,001,877

[45] Date of Patent: Mar. 26, 1991

[54] DECORATIVE WALL AND CEILING MOLDING ASSEMBLY

[76] Inventor: Troy C. Edwards, 2801 Church Dr., Denton, Tex. 76201

[21] Appl. No.: 321,722

[22] Filed: Mar. 10, 1989

[51] Int. Cl.[5] ..... E04B 5/00

[52] U.S. Cl. ..... 52/288; 52/287; 52/280; 403/295; 403/298

[58] Field of Search ..... 52/281, 287, 288, 717, 52/280, 290, 656; 403/295, 298, 292

[56] References Cited

U.S. PATENT DOCUMENTS 1,825,010 9/1931 Murphy ..... 52/287

3,201,910 8/1965 Keesee ..... 52/287

*Primary Examiner*—David A. Scherbel

*Assistant Examiner*—Creighton Smith

*Attorney, Agent, or Firm*—Hubbard, Thurman, Turner, Tucker & Harris

[57] ABSTRACT

An interior wall partition trim assembly for providing a decorative trim molding at the ceiling-wall junction and corners together with a decorative chair rail trim member for trimming walls and corners intermediate the ceiling and floor, the combination of ceiling trim splice members shaped to fit supportingly inside the abutted ends of elongated hollow ceiling trim moldings and chair rail trim splice members shaped to fit inside the abutted ends of hollow chair rail trim members to position the respective abutted ends in even registration when fastened to a ceiling junction and wall, respectively. The splice members and mounting fasteners are accessible for mounting or demounting by pivotable decorative panels on each ceiling and chair rail trim member which close to hide the respective splice members and fasteners. Right angled corner cap junction members have ceiling trim molding insert adapters. Right angled chair rail corner bodies have chair rail trim member insert adapters. The insert adapters are inwardly offset at an abutment edge from decorative surfaces on said arms matching decorative surfaces on the corresponding trim members when ends of said trim members are positioned to cover insert adapters in contact with an abutment edge. This provides a continuous appearing trim molding decorative surface around corners. The insert adapters are also accessible for mounting and demounting by means of the pivotable decorative panels on ceiling moldings or chair rail trim members. End cap members are provided for open ends of ceiling trim moldings or chair rail trim members.

32 Claims, 6 Drawing Sheets

DECORATIVE WALL AND CEILING MOLDING ASSEMBLY

BACKGROUND OF THE INVENTION

1. Field of the Invention

This invention is a decorative molding for the junction between vertical walls and a horizontal ceiling including a decorative chair rail assembly for mounting on walls intermediate a floor and a ceiling.

2. Background

It is commonly desired to dress-up what may be called the junction or intersection between the walls and the ceiling of the room. A decorative molding applied along the intersection between each wall and the ceiling of a room covers any unfinished gaps or defects and provides an asthetically pleasing finished look to the room.

Although various materials have been employed in the construction of such moldings, perhaps the most commonly used trim is made from wood. Wood has the advantage of being relatively inexpensive and easy to fabricate with various curved decorative surfaces which face the interior of the room when the trim is installed at the intersection of walls and ceiling. An example would be quarter round which is supplied in long lengths cut with square butt ends. The quarter round is nailed in place along the wall-ceiling junction and the end of one piece is butted against the end of another piece along the junction around the room. Such joints are necessary both because the quarter round may not be long enough in some cases, or simply for economy to avoid waste of molding material.

It is necessary to make 45 degree angled cuts in the molding at inside or at outside corners in order to achieve the desired finished look. These cuts must be made at the job site and it is often difficult to match the ends both because of deficiencies in wall-ceiling construction and tolerances in the molding material itself not to mention the errors inherent in making angled cuts to fit exactly together.

Hollow shapes fabricated from metal or plastic are sometimes used for trim molding, but it is always necessary to make butt joints in trimming the intersection between walls and ceiling for the reasons mentioned. Even though extruded molding or molding fabricated from inexpensive sheet metal, for example, may be produced with uniform cross-section, it is still difficult to make neat butt joints from one piece to the other or to make neat angled joints at the corner itself. Non-flush edges of abutting trim members mounted at the junction are easily caused by a all too common variations in the surfaces of the walls and ceiling along the intersection and the fact that one trim member is lying along one portion of the wall and another trim member is lying along a different part of the wall. Over a considerable length, these variations often make it difficult to get a neat butt joint on trim which is actually fixed at different parts of the wall. Even a small difference in the position of the edges at a joint in a trim molding are objectionable because they are easily seen, especially if highlighted by sunlight or other lighting conditions in the room.

An additional problem is the difficulty in fixing the molding to the wall junction intersections without leaving the fastening devices or vestiges of the fastening devices visible under certain lighting conditions which is similarly objectionable. Painting, wallpapering, or other repairs, provide a particular problem because it is necessary to remove the trim molding in order to perform renovating, decorating, and maintenance tasks followed by replacement of the molding back in its original location. Frequently, the removal of trim is accompanied by cracking, splintering or other damage that necessitates the purchase and installation of new trim molding. Thus, it would be desirable to have an attractive decorative molding assembly with neat joints between pieces, with the edges in close registration with each other, which was conveniently installable without visible fasteners and which is removable and reinstallable.

Decorative and asthetically pleasing chair rail trim assemblies are also commonly used by mounting along each wall around the room at a chair contacting height intermediate the floor and ceiling. The chair rail serves as a "bumper" in case the chair is accidentially pushed against a wall to prevent any damage to the wall itself. In addition, it adds a pleasing finished look to the wall. The same advantages and problems exist with the chair rail molding assembly as with the ceiling-wall trim molding assembly. Neat butt joints with convenient installation and removal and replaceability are desired as with the ceiling molding assembly. It is to this end that the present invention has been developed with a view to providing an interior ceiling-wall or partition trim assembly and a chair rail assembly which utilizes several unique components to provide a trim assembly with neat joints that is easy to install, economical, removeable, replaceable, and attractive in appearance.

SUMMARY OF THE INVENTION

The present invention pertains to an improved interior ceiling-wall decorative trim molding assembly and a complimentary chair rail trim molding assembly which are relatively easy to fabricate and which are easy and conveniently installed and which may easily be removed and later reinstalled. Joints between individual pieces of the assembly are neat with their edges in even registration.

The improved trim assembly for the intersecting junction between walls and ceiling (ceiling trim molding) is a hollow plastic molding which is conveniently extruded from plastic, having a decorative panel which is hinged to provide an openable and recloseable feature. The hinge is preferably an integral living hinge in the wall of the ceiling molding. The ceiling trim molding has a flat ceiling contacting surface and a flat wall contacting surface which are conveniently fixed to both surfaces by means of fasteners such as screws.

The hinged decorative panel is pivotable between an open and a closed position. When the hinged decorative panel is pivoted to an open position, each of the flat support surfaces of the ceiling trim molding are conveniently and easily fastened by screws which will be hidden when the decorative panel is pivoted to its closed position. There is a means for holding the decorative panel in its closed position which is releaseable to allow the decorative panel to pivot.

A splice member is used to join two lengths of ceiling trim molding, provide support for the decorative panel, and align the edges of the trim molding in even registration with each other. The splice member is shaped to slide part way inside the hollow squared-off end of each of two ceiling trim members which are to be butted together. The splice member itself also has a flattened ceiling support surface and a flattened wall support surface to be used for mounting in contact with the respective flattened ceiling and wall contacting panels of trim moldings and helping to register the edges of a butt joint between ceiling trim molding members. The flattened support surfaces of the splice member are shaped and adapted to contact the flat ceiling and wall mounting surfaces on a ceiling trim member on the inside surface of the wall forming the hollow ceiling trim molding.

Roughly half of a short section of splice member is slid inside the hollow end of each of two ceiling trim members to be abutted to make a butt joint. The decorative panels of each ceiling trim molding are pivoted to an open position for access to the support surfaces whereupon fasteners are shot through the support surfaces of the splice member then through the support surface of the ceiling trim molding and then into the respective ceiling or wall to fix the trim molding in position. This is done after the two ceiling trim moldings are abutted together over the splice member to form a neat butt joint. The splice member also has a projection which helps establish the position of and supports the pivotable decorative panels of abutted ceiling trim moldings when they are pivoted to a closed position to hide the splice member from view which also hides the fasteners used for mounting.

The ceiling trim moldings may be demounted by reversing the steps used in assembling and mounting the ceiling trim moldings and splice members to wall and ceiling surfaces.

At the corners where the walls intersect with each other adjacent the ceiling, a corner cap junction member is used to make a smooth corner transition with even joints between ceiling trim moldings decorating the junction between each of the intersecting walls and ceiling. The corner cap junction member is preferably a unitary body with right angularly related wall extending arms which is shaped to fit in the corner. In position for use, it is in contact with both intersecting walls and ceiling and which has a complimentary decorative panel on each arm which is shaped and contoured just like the decorative panel of the ceiling trim molding. The wall extending legs should be halves of the corner cap junction member which each lie along a wall adjacent a corner and which terminate at an abutment edge which lies in a plane which is perpendicular to one intersecting wall surface and parallel to the other intersecting wall surface. Extending a short distance beyond each abutment edge is a trim member insert extension or adapter which in position for use extends from the junction member body in a direction which is parallel to the to the line of intersection of a given wall and ceiling. The trim member insert extension has a wall with an outside periphery which is offset from the adjacent decorative surface of the junction member an amount which is equal to the thickness of the wall of a trim member molding and by at least that amount at all other adjacent surfaces of the junction member half to which it is affixed. Each insert is shaped to fit inside the hollow end of a trim member molding in at least partial support of the decorative surface of said molding when the trim member molding is mounted over the insert with the end abutted against the abutment surface of the corner cap junction member. Each of the trim member insert extensions has a mounting surface for the ceiling and a mounting surface for the wall, opposite which are openings in the wall of the insert closest to the inside of the room when mounted, for access to the mounting surfaces.

Installation is accomplished in a manner similar to the previously described splice members in that a trim member ceiling molding is placed over an insert and abutted against the abutment edge. The decorative panel is open to the open position and screws are shot through the wall and ceiling support surfaces of the insert thence through the wall and ceiling support surfaces of the trim member molding and then into the ceiling and walls. This is done on each wall extending arm of the corner cap junction member. These fasteners simultaneously hold the corner cap junction member in place at the corner as well as holding one end of a ceiling trim molding running horizontally along the intersection of each wall and ceiling opposite the corner. The ceiling trim moldings are then fastened at other places on the wall-ceiling intersection for additional support. A neat butt joint is formed between the ceiling trim moldings and the corner cap junction member which is partially supported in even registration by the insert extensions or adapters creating continuous smooth surfaces along the ceiling trim moldings and junction member. The trim assembly is conveniently and easily removable and remountable by reversing the process, for remounting at a subsequent time.

The chair rail trim assembly is similarly constructed and provides the same advantages of smooth continuous surfaces at butt joints without visible edges and being easily mountable and demountable as well as remountable. An elongated hollow chair rail trim member, preferably extruded from plastic, has a pivotable decorative panel pivotable between an open position for installation and closed position for use. A relatively short splice member is designed to fit supportingly into the hollow end of each of two said chair rails, roughly half in each, to form a neat butt joint between one of the chair rail trim members and another of the chair rail trim members when a hollow end of one chair rail trim member and a mating hollow end of another chair rail trim member are abutted to cover the insert from view. The insert when fitted inside a chair rail trim member provides at least partial support for the pivotable decorative panel of the chair rail trim member when it is pivoted to the closed position.

The chair rail splice member is preferably of hollow-wall construction with openings in the decorative wall supporting portion to pass the head of a screw which is used to install the spliced chair rail assembly by passage through said opening, through the opposite back wall of the splice member, then through the wall contacting surface of the chair rail trim member and into the wall. One screw so fixed to the wall on either side of the butt splice may be sufficient to secure it to the wall for use. The fasteners are hidden from view when the pivotable decorative panel is closed and accessible when it is open.

The chair rail assembly has a chair rail corner body adapted to fit into corners where two walls intersect, the corner body has wall extending right angularly arranged arms forming the body each of which has a wall contacting surface which is mountable to intersecting walls in position for use in the same manner as is the corner cap junction member described earlier. When positioned for use, each of the arms will extend along one of the intersecting walls.

Opposite the wall contacting surfaces, the chair rail corner body has angularly related intersecting room facing decorative surfaces which are shaped to correspond to and cooperate with with the surfaces of a chair rail trim member in order to create continuous smooth surfaces along a wall to a corner. Each of the wall extending arms terminates at an abutment surface having a chair rail trim member adapter extending therefrom, each adapter having a wall defining the outer surface of the adapter. The outer surface of the adapter wall is offset inwardly on the abutment surface by about the thickness of the wall of a chair rail trim member, at least at that portion of the adapter wall that is adjacent the decorative surface located on the adjoining arm of the corner body. The wall is similarly offset at least at sufficient other places around the abutment edge to provide support for the wall of the hollow end of a chair rail trim member in even registration with the corresponding surfaces of the corner body member when an end of a chair rail trim member is mounted over said adapter with the trim member abutting the abutment edge of the arm and hiding the adapter from view.

Each of the adapters has a wall mounting surface with screw head passing openings in the adapter opposite the wall mounting surface wall. Installation is achieved by pivoting the decorative portion of the trim member to the open position placing it over the adapter abutted against the chair rail corner body abutment edge whereupon the body and the trim member are simultaneously fastened adjacent the corner by shooting one or more screws through the wall mounting wall of the adapter, then through the wall contacting surface of the chair rail trim member and into the wall. When the pivotable decorative panel is closed, the adapter and fastening screws are hidden from view and a neat butt joint is formed between the corresponding decorative surfaces of the corner body and chair rail trim member giving the appearance of continuous surfaces along the trim member and corner body along a given wall. The chair trail trim member assembly is easily demountable by reversing the process and is remountable as before.

In addition, respective end caps are adapted to fit the ceiling trim molding and the chair rail trim member to give a finished look by closing the open hollow end of either. The caps are shaped to match the shape of the hollow, having a snug fitting reduced section corresponding in shape to that of the respective hollow in a respective ceiling trim molding or chair rail trim member. The caps fit snugly by friction but may be glued or otherwise fastened in place at a squared off end of one of said members. The caps are useful when a ceiling or chair rail trim member ends at a door frame or window where it needs to be closed off.

Both the wall trim cap assembly and the chair rail trim assembly are particularly effective when used together to provide a finished look to a room. Joints between the wall extending ceiling trim moldings and the corner cap junction members as well as joints in the wall extending trim moldings themselves are particularly pleasingly effective. This is especially because the decorative edges of the wall extending ceiling trim members or the comparable chair rail members are supported by the insertable splice members in the wall extending portions and supported by the trim member extensions or adapters at joints with corner cap junction members or, in the case of the chair rail, at the joint with the chair rail corner body.

The pivotable decorative panel on each of the ceiling trim moldings and on the chair rail trim members make for a convenient and easy installation in assembly and disassembly and are remountable conveniently and easily. No fasteners are visible after installation and there are no holes to fill. Yet the mounting fasteners are easily accessible just by pivoting the decorative panel which covers them to the open position. Long lengths of the ceiling trim moldings and chair rail trim members are economically produced to close tolerances by the extrusion process as are the insertable splice members which are easily cross-cut to their useable lengths. An economical coextrusion process can be used to provide a living hinge in the wall of the ceiling trim molding and in the wall of the chair rail trim member to provide an integral hinge for the pivotable decorative panel therein. The coextrusion process can provide flexibility in the integral hinge being made of a flexible plastic with the remainder of the member being made of a more rigid type of plastic.

Those skilled in the art will recognize the above described features and advantages of the present invention as well as additional superior aspects thereof upon reading the detailed description which follows in conjunction with the drawings.

DETAILED DESCRIPTION OF THE PREFERRED EMBODIMENTS

Figure 1:
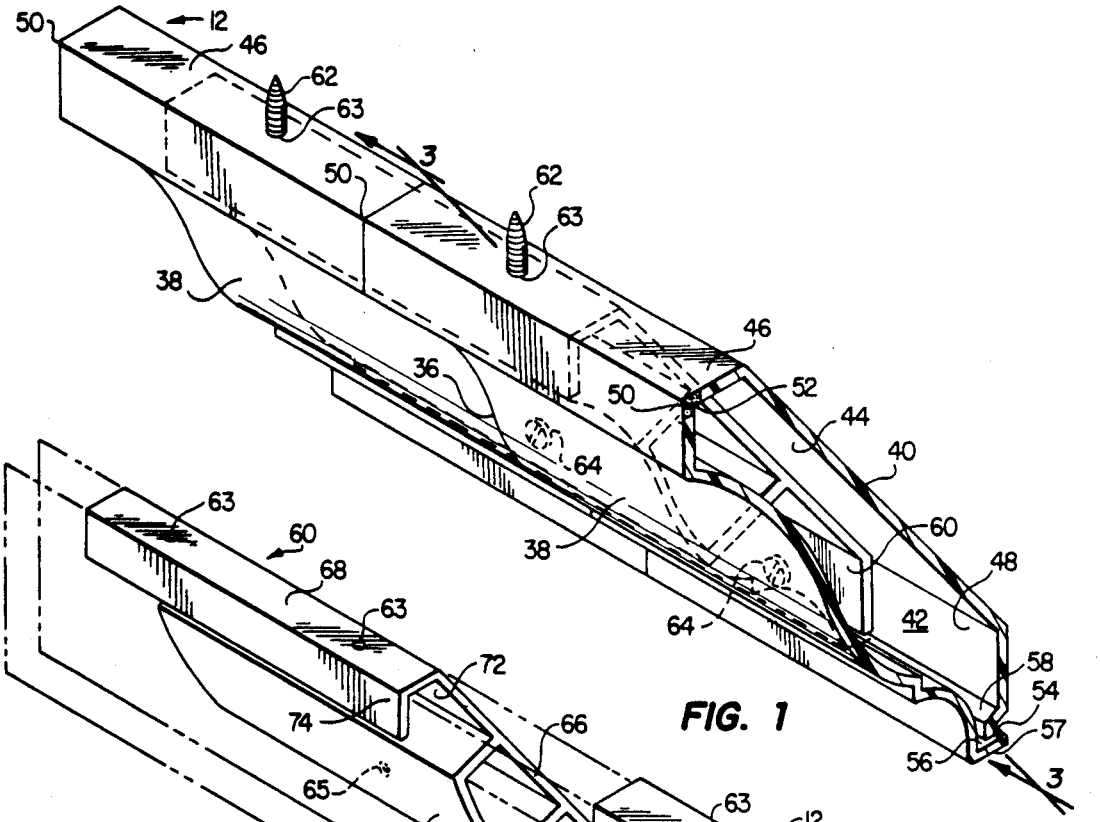
FIG. 1 is a perspective view of a wall trim cap assembly comprising a butt splice between two ceiling trim moldings as they would be installed over a splice member shown in phantom, with fasteners hidden from view.

In the description which follows, like parts are marked throughout the specification and drawings with the same reference numerals, respectively. Certain features of the invention may be shown exaggerated in scale in the interest of clarity.

Figure 11:
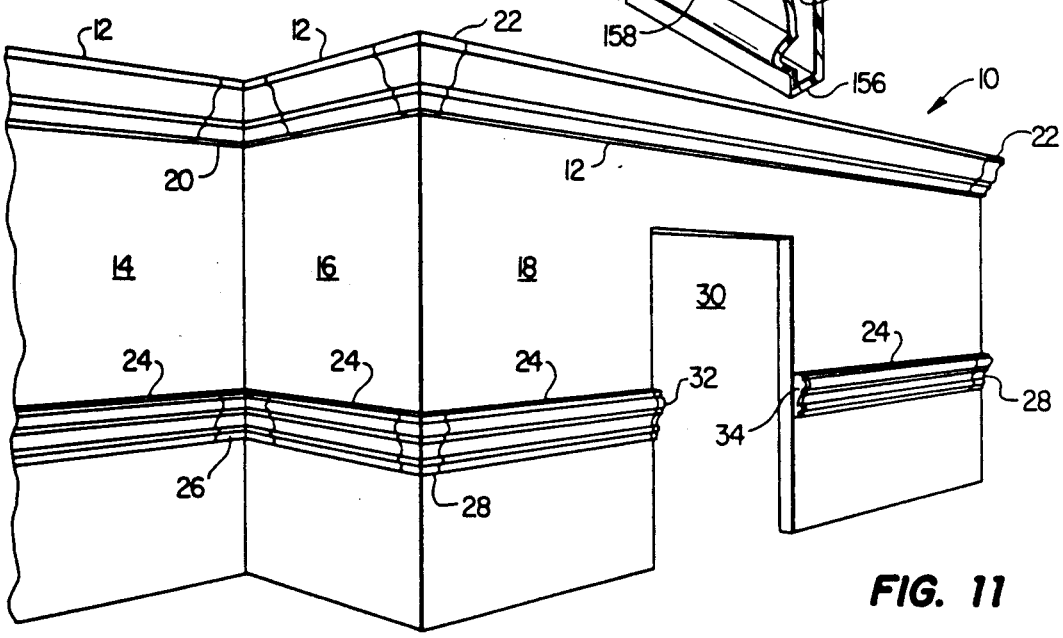
FIG. 11 is a perspective view, showing a general layout on intersecting vertical walls, of the wall trim cap assembly with inside and outside corner junction members in combination with a wall trim chair rail assembly including inside and outside chair rail corner bodies with left and right end caps at a doorway.

FIG. 11 shows a complete wall trim assembly 10 mounted for use on a series of intersecting vertical walls of a room partition, one of which includes a doorway. Various lengths of ceiling trim moldings 12 are seen mounted on right angularly intersecting vertical walls 14, 16, and 18. Each of the ceiling trim molding 12 are connected to one leg of an inside corner cap junction member 20 or an outside corner cap junction member 22, the corner cap junction members having decorative surfaces on each leg which correspond to the decorative surface on the ceiling trim moldings so that a smooth continuous decorative surface is seen along the walls and through the corners all along the top of the intersecting walls. The chair rail assembly is also seen in FIG. 11 including various lengths of chair rail trim members 24 each of which are connected to an inside chair rail corner body 26 or an outside chair rail corner body 28. Wall 18 has a doorway 30 which interrupts chair rail trim members 24 on wall 18 which are cut off at the frame of the door. The cut off hollow ends of chair rail trim members 24 on wall 18 are finished off with right hand chair rail end cap 32 or left hand chair rail end cap 34. Each of the chair rail corner bodies have decorative surfaces which correspond with decorative surfaces on the chair rail trim members such that a smooth continuous decorative surface of the chair rail trim members and chair rail corner bodies are seen along the walls and through the corners of the walls 14, 16, and 18 except where the chair rail is interrupted by the door. Left and right end caps for the ceiling trim molding are also provided, as with the chair rail trim members, but not shown in FIG. 11. The complete wall trim assembly 10 also includes important splice members for the ceiling trim and chair rail trim which are hidden from view in FIG. 11. They are best seen in FIGS. 1–3 and FIGS. 6–8 respectively.

FIG. 1 illustrates a completed butt joint between two sections of ceiling trim molding 12. The actual butt joint is represented by the line 36 all the way around the squared-off mating ends of the two joined ceiling trim members 12. Ceiling trim members are hollow moldings which are lengthy pieces of uniform cross-section. They are formed of a wall 40 which encloses a hollow 42 when the trim members are closed. Wall 40 forms a series of connected panels including a flattened ceiling contacting panel 46 and a flattened wall contacting panel 48 joined by a back panel 44. A decorative panel 38 is pivotally hinged to panel 46 by means for hinging 50 which is preferably an integrally formed so-called living hinge in wall 40, decorative panel being a further continuation of wall 40 beyond hinge 50. Hinge 50 is located at the extremity of the ceiling contacting panel opposite where the ceiling panel is joined with the back panel. It is stippled in the drawings merely for purposes of illustrating its location in wall 40 and to indicate that it is composed of a different plastic than the remainder of wall 40. Hinge 50 may also be said to be a hinge line in wall 40 which is not sharply defined because it is integral, but may be shown as hinge line 52 in FIG. 1. This corresponds to the hinge pin of the conventional hinge.

Opposite hinge 50, decorative panel 38 continues to an edge 54 running along the length of ceiling trim molding 12 essentially parallel to hinge 50. Edge 54 being shaped to provide a releasable means for holding 56 having flat bottom panel 57, cooperates with a shaped extending portion 58 formed as a continuation of panel 48 which together cooperate to allow decorative panel 38 to be fixed in closed position or released to be pivoted about hinge 50 at approximately hinge line 52. It is to be understood that the releasable means for holding 56 preferably runs continuously along ceiling trim molding 12 and decorative panel 38 is thus openable and closeable between a closed position and an open position, the closed position being represented in FIG. 1. It is also understood that the location of the means for hinging and the releaseable means for holding could be reversed to have the decorative panel 38 pivot at an extension of panel 48 and be releaseably held at a modified means for holding on the extremity of panel 46.

Also shown in FIG. 1 is a ceiling trim splice member 60 shown mostly in phantom, positioned half in each of the hollow ends of abutting ceiling trim moldings 12. Finally, ceiling fasteners 62, illustrated as screws, are seen protruding through openings 63 in splice member 60, ceiling panel 46 thence into a ceiling. In phantom are shown wall fasteners 64 which similarly pass through openings 65 in splice member 60, (seen in FIG. 2) through wall panel 48 then into a wall.

Figure 2:
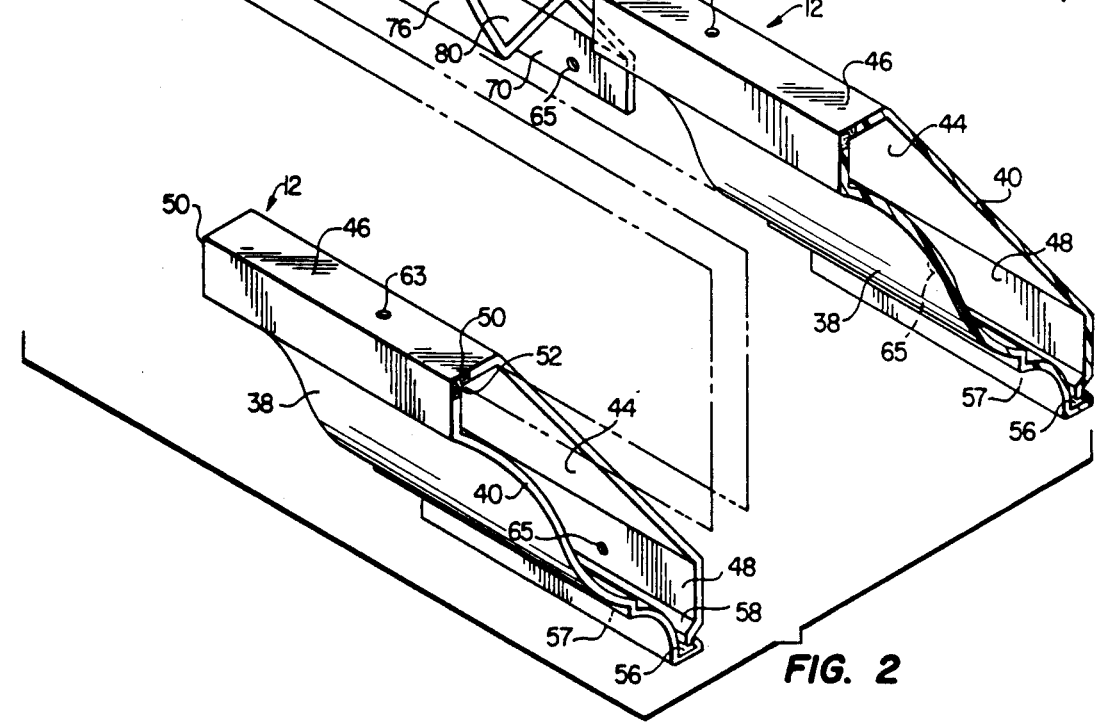
FIG. 2 is an exploded view of the splice member and abbreviated ceiling trim moldings of FIG. 1.

FIG. 2 is in exploded view the butt splice which is seen assembled in FIG. 1. Ceiling trim splice member 60 is formed from wall 66. Splice member 60 is preferably formed in long lengths of uniform cross-section which are cross-cut to appropriate splice-making size. This splice member has a ceiling panel 68 and a wall panel 70 separated by a back panel 72 and forming angular extensions thereof. The ceiling panel may continue to form an angularly related support panel 74. Ceiling panel 68 may be provided with spaced apart fastener openings 63 for fasteners 62. Likewise, wall panel 70 may be provided with spaced apart fastener openings 65 for fasteners 64.

Wall 66 of ceiling trim splice member 60 further includes a projecting panel 76 attached to and extending from back panel 72 by panel legs 78 and 80 which constitutes a support for the decorative panel 38 of a given ceiling trim member 12 when the splice member is inserted into the hollow 42 in the end of a hollow trim member. In assembly, the projecting panel and panel legs may be said to lie intermediate the means for pivoting and the means for holding of a ceiling trim member which surrounds it. The projecting panel lies intermediate the ceiling panel and wall panel of the splice member itself.

In assembly with the open end of a ceiling trim member, the projecting panel is a supporting extension projecting towards and in supporting contact with a portion of the decorative front panel when the trim member covering it is in closed position. Projecting panel 76 is spaced away from back panel 72 on the splice member and its outer surface is contoured to match the contour of the inner surface of the pivotable decorative panel 38. The same cross-section of a given splice member or ceiling trim molding is maintained at any particular location along its length.

Figure 3:
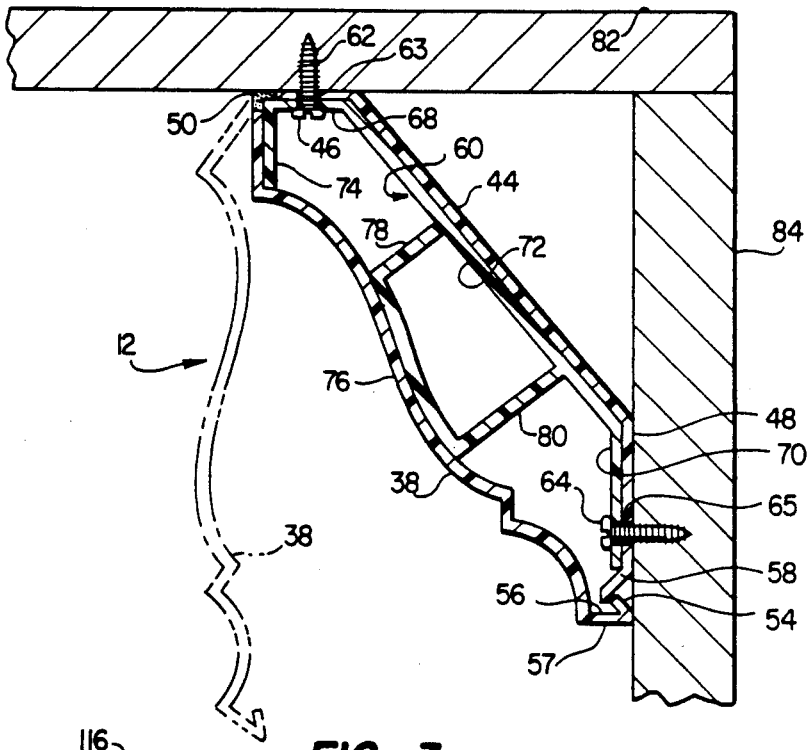
FIG. 3 is a cross-sectional view on line 3—3 of FIG. 1 illustrating the cross-section of the splice member and ceiling trim molding in the closed position as mounted to the horizontal ceiling and vertical wall at a ceiling-wall intersection showing in phantom the open position of a ceiling trim member.

Splice member 60 is adapted to fit closely inside the hollow end of a ceiling trim molding with one of the surfaces of the panels making up the walls 66, including ceiling panel 68, back panel 72, and wall panel 70 lying directly under and in contact with the respective inside surfaces of ceiling contacting panel 46, back panel 44, and wall panel 48. As indicated in FIGS. 1 and 2 and more clearly in FIG. 3 is an end view of the assembly of FIG. 1 mounted over the intersection between a ceiling 82 and a wall panel 84 with the splice member 60 mounted inside the ceiling trim molding 12. The panels formed by the wall of the splice member are slightly smaller than the corresponding panels of the ceiling molding so the splice member will fit inside the trim molding as shown in FIG. 3. In assembly, flat ceiling panel 68 has its surface flat against the inside surface of ceiling contacting panel 46' which lies horizontally against the room surface of ceiling 82. The surface of wall panel 70 lies flat against the inside surface of wall contacting panel 48 having its wall contacting outer surface vertically against the room surface of wall 84. Decorative panel 38 is spaced away from back panel 44 by wall and ceiling panels 46 and 48 (when closed) which wall and ceiling panels may be said to be like wall and ceiling contacting extensions of back panel 44 which are angled to lie flat in contact with respective wall and ceiling surfaces when installed. Back panel 44 connects panels 46 and 48 and is angularly related thereto. Back panel 72 connecting panel 68 and 70 has its outer surface in contact with the inside surface of panel 44 due to its having the same angular relationship as panel 44 and receives support from panel 44. Panel 74 is preferably in supporting position for a portion of decorative panel 38 when panel 38 is pivoted to the closed position. Likewise, the exposed surface of projecting panel 76 is spaced away from back panel 72 by panel legs 78 and 80 and through them receives support from back panel 72.

The contacting surface of projecting panel 76 is curved to match the corresponding curve of the inside surface of a portion of decorative panel 38 to position it and provide support for it when panel 38 is pivoted to the closed position with releasable means 56 having an edge 54 held by the shaped portion 58 extending from wall contacting panel 48 of the ceiling molding. Panel 38 is openable and pivotable to an open position because it has some flexibility which allows the releasable means for holding 56 to be disengaged from shaped portion 58. Releasable means for holding 56 is conveniently integrally formed on the wall of the ceiling molding. It has a flat bottom 57 to match the height of a vertical door jam trim member to be described later.

With the decorative panel 38 pivoted to the open position indicated by the alternate position in FIG. 3, ceiling fasteners 62 may be passed through opening 63 in splice member 60, then through ceiling contacting panel 46 in ceiling molding 12 then into ceiling 82 to secure the assembly in place where a butt joint is made between the mating hollow ends of two abutted ceiling trim moldings. Similarly, screws 64 are passed through openings 65 in wall panel 70 of splice member 60, then through ceiling contacting panel 48 of ceiling molding 12, then into a vertical wall or partition 84 to secure the opposite wall ends of a butt splice assembly.

Splice member 60 aids in making a neat butt joint between the decorative surfaces 38 of each of two abutting ceiling trim moldings along line 36 so that the decorative surface appears smooth and continuous along the intersection between walls and ceiling. Similarly, it helps align the top surfaces 46 of abutting trim members, especially if the ceiling is irregular in the area where the joint is made. Additional fasteners like fasteners 62 and 65 are used at spaced apart places as needed respectively through panels 46 and 48 of any trim member 12 at other places where there is no joint, and consequently where there is no splice member. In either case, once the mounting screws are installed, decorative panel 38 is pivoted to the closed position completely covering from view any fasteners and any splice members that are employed.

Figure 4:
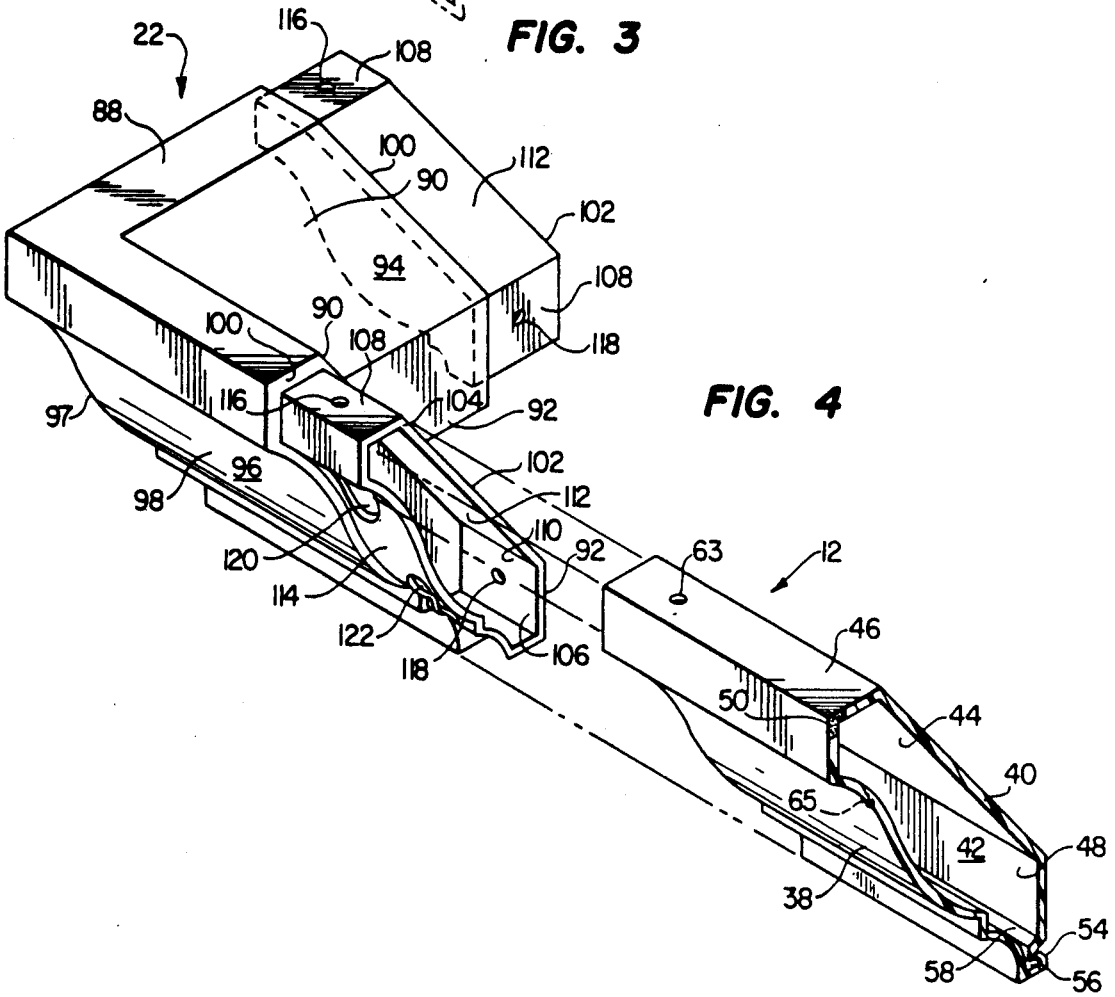
FIG. 4 is a perspective view of an outside corner cap junction member having trim member inserts on each leg with a cut-away ceiling trim molding in position for sliding over the insert to form a butt joint with the junction member.

FIG. 4 represents a room partition wall trim cap assembly for trimming the junction between wall panels and ceiling through a vertical wall corner for use with the openable and closeable ceiling trim molding 12. Corner cap junction member 22 is for an outside corner to trim the junction between the ceiling and two vertical intersecting walls. Junction member 22 is a hollow body having like right angled arms 94, 96 with corresponding right angularly related intersecting surfaces. By this is meant that lines can be drawn on the corresponding surfaces of the wall extending halves 94, 96, said lines being in a horizontal plane perpendicular to the walls along which the halves extend in use position, which lines will intersect at right angles. Said another way, the plane referred to would be parallel to a plane lying on ceiling contact surface 88. The top of the junction member has a flat ceiling contact surface 88 which merges into a back panel 90 on each of the halves. Panel 90 is connected to a flat wall contact surface 92 on each of the wall extending halves 94 and 96. Surfaces 92 are angled at right angles to each other. Surface 88 and surfaces 92 are oriented respectively horizontally and vertically so that when the corner cap junction member is placed at an outside corner in position for use, surface 88 is in contact with the ceiling and each of surfaces 92 are in contact with one of the vertical intersecting walls of the corner. Each of arms 94 and 96 have a decorative surface 98 extending between and forming a continuation of surfaces 88 and 92. Surfaces 98 come together at intersection 97 which in position of use is spaced away from the corner. The shape or contour of decorative surfaces 98 exactly corresponds to the contour of the decorative surface of decorative panel 38 when trim molding 12 is assembled in line with and in contact with one of the arms of junction member 22 in position for use.

The wall extending halves or arms terminate at an abuttment edge 100 which lies in a vertical plane with the junction member located in position for use. This plane may be said to be parallel to one of the flat wall contact surfaces 92. Fixed to and extending away from the abutment edge 100 of each wall extending halves or arms are short trim member insert extensions or adapters 102 which have the same shape and construction except that they are left and right handed. If the trim member inserts 102 were cut off at a respective abutment edges 100 and those cut-off edges were then mated together, the cross-sections would match exactly.

Each insert or adapter 102 has a wall 104 enclosing a hollow 106 and forming a series of interconnected panels including a top panel 108 and a bottom panel 110 separated by a back panel 112. The wall of the insert adapter further includes a decorative support panel 114 as a continuation of the wall extending from and between the bottom panel 110 and top panel 108, further including an opening 116 for a ceiling fastener. Panel 110 further includes an opening 118 for a wall fastener. Decorative support panel 114 further includes cut-away 120 for a ceiling fastener and cut-away 122 for a wall fastener which are large enough to pass the head of a mounting screw and screwdriver to be used in mounting corner cap junction member 22 to the ceiling by means of screws through openings 116 and to the intersecting walls by means of fasteners through openings 118.

The trim member insert extensions 102 are shaped to fit in supporting contact inside the hollow 42 of a squared-off end of a ceiling trim molding 12 in the same way that the ceiling trim splice member fits inside the ceiling trim molding as shown in FIG. 3. The panels making up the ceiling trim inserts have surfaces which are parallel to corresponding surfaces on the arms of the junction member except that those panels are offset at the abutment edge by at least the thickness of the wall 40 of ceiling molding 12 everywhere around the abutment edge, the offset being equal to the thickness of wall 40 for panels 108 and 110, for at least part of decorative support panels 114 and at least part of back panel 112 in order to provide support for and position ceiling molding 12 when it is slipped over the insert or adapter. The squared off edge of a given trim member edge is abutted against the abutment edge 100 all around so that the edge of the abutting decorative facing surface and the edge of the abutment along the surface of decorative surface 98 of corner junction member 22 are in even registration with the ceiling molding in the closed position to give the appearance of a smooth continuous decorative surface along both walls and through the corner when corner junction member 22 is mounted at a corner with a ceiling trim molding mounted over each of the trim member insert extensions or adapters and mated with abutment edges 100.

Installation is easily accomplished because after trim molding 12 is placed over a given insert 102, it may be pivoted to an open position to give access to the cutouts 120 and 122 so that mounting screws may be passed through openings 116 in panel 108 then through openings 63 in panel 46 and on into the ceiling. Likewise, a fastener may be accessed through cut-away 122, passed through openings 118 in panel 110, then through panel 48 and into a vertical wall or partition surface. This mounts junction member 22 and one end of each trim molding 12 together in place adjacent the corner to trim the corner. After the mounting as described takes place, the ceiling molding is pivoted to the closed position thus hiding the mounting screws and completely hiding the trim member insert extensions or adapters so that a smooth continuous decorative surface is seen all around.

Certain portions of the insert adapter may be offset at the abutment edge at more than the thickness of the wall 40, especially at the bottom where the decorative panel 114 joins panel 110 so as to provide clearance for the releaseable means for holding 56 of the trim molding when it is installed. Because the fasteners and inserts are hidden from view in assembly, the finished outside corner junction member when installed with trim members on each side will appear as does item 22 in FIG. 11 with smooth decorative surfaces running along both walls and intersecting right angularly at a vertical junction spaced away from and directly above the line of intersection of two intersecting wall panels.

Figure 5:
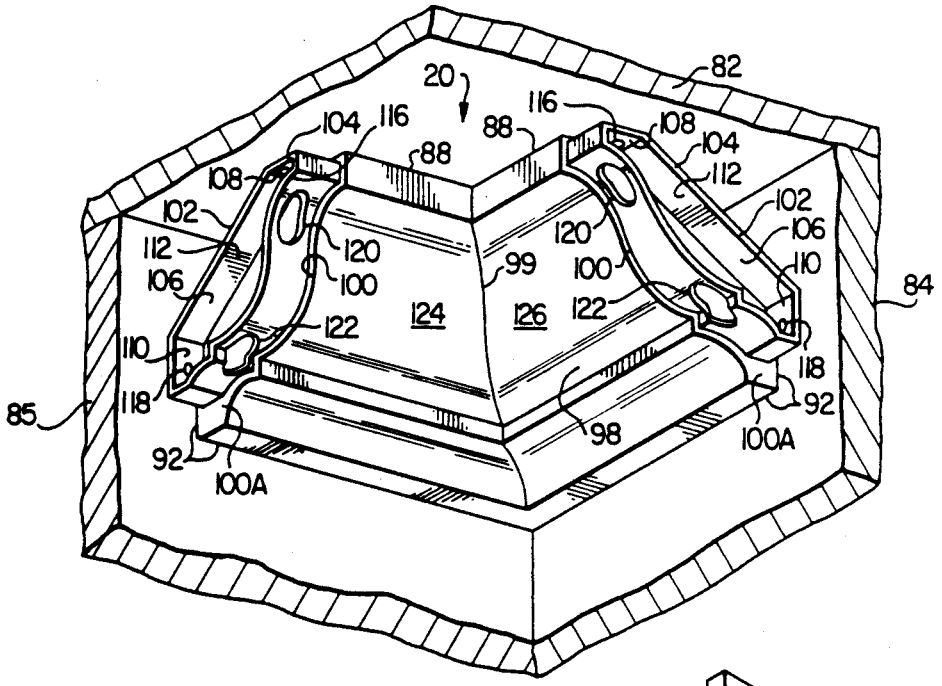
FIG. 5 is a perspective view of an inside corner cap junction member with its extending ceiling trim molding adapters in position for use at the inside corner of a cut-away ceiling and intersecting wall junction.

FIG. 5 is an inside corner cap junction member 20 which is a hollow body with like right angled arms 124 and 126 which has the same features and construction as the corner cap junction member shown in FIG. 4 except that the right-angled arms in FIG. 5 form an inside right angle instead of an outside right angle as in FIG. 4 as related to an inside corner rather than an outside corner in a room. FIG. 11 shows an inside corner between walls 14 and 16 and an outside corner between walls 16 and 18. In FIG. 5, corner junction member 20 is shown installed up against a ceiling 82 and against vertical walls in a corner having adjoining walls 84 and 85. At the top of junction 20 is a flat ceiling contacting surface 88 which except for the edge is hidden in FIG. 5. Also hidden except for the edges are the flat wall contacting surfaces 92 of body 20 which are angled at 90 degrees to each other and in contact with walls 84 and 85. Decorative surfaces 98 intersecting at boundary 99 face away from the corner into a room. These surfaces have the same contour as and will match exactly in even registration with the exposed surfaces of decorative panels 38 which are mounted over insert adapters 102, in the closed position, just as previously described. Each of the arms of junction 20 terminate at abutment edges 100 from which extend trim member inserts or adapters 102 which extend a short distance beyond abutments 100 in the same direction as arms 124 and 126. Each of the adapters 102 have a wall 104 forming a series of connected panels including flattened top panels 108 and bottom panels 110 separated by back panels 112. Wall 104 of adapters 102 enclose a hollow 106 and bottom panel 110 has fastener openings 118. Fastener openings 116 are in top panels 108. Cut-outs 120 and 122 are provided in each adapter 102 for access to the fastener openings 116 and 118. The outside surfaces of the connecting panels of inserts 102 are, as before, offset inwardly from the surfaces of arms 124, 126 by at least the thickness of the ceiling trim moldings 12 which will fit over the adapters with their squared-off ends abutted against the respective abutment edges 100 when trim moldings are used along each wall and connected to junction 20. The offset may be greater as at the portions of the abutment edge designated as 100A in FIG. 5 to allow room for the releaseable means for holding 56 of trim molding 12 when it is installed on insert 102.

Figure 5A:
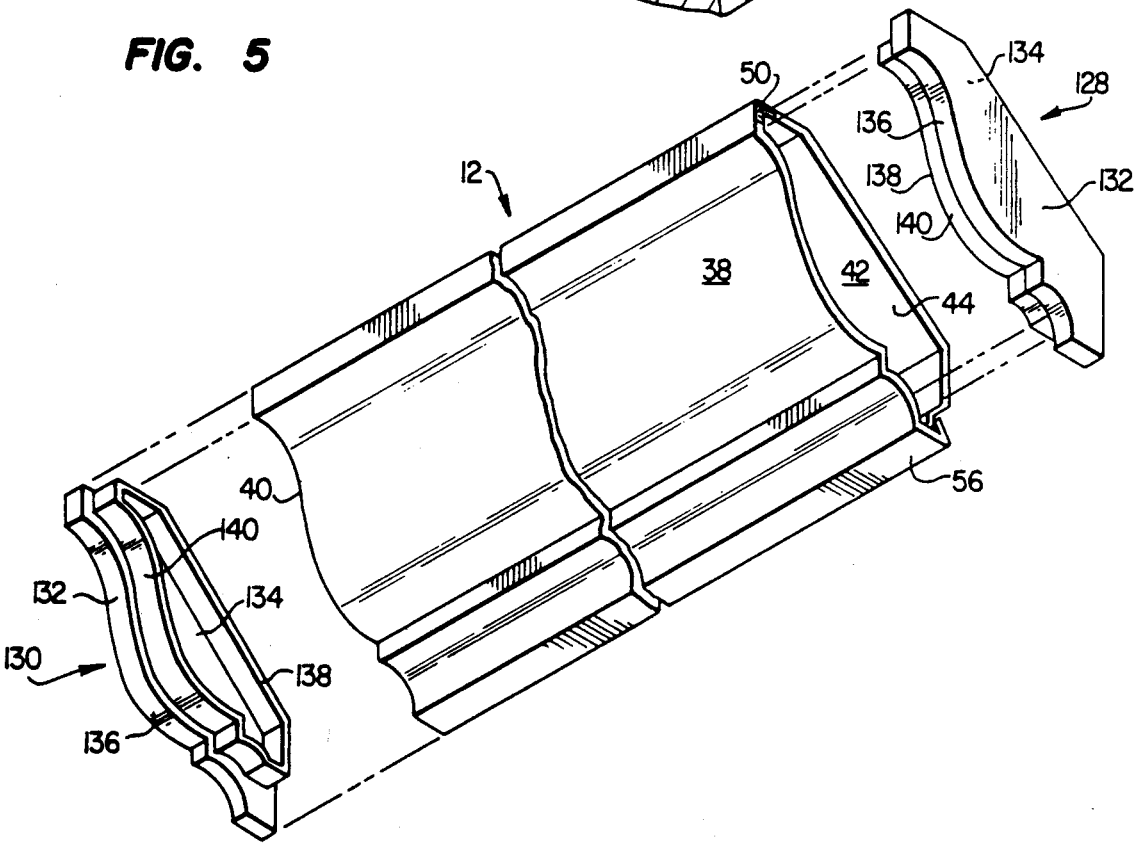
FIG. 5A is a perspective view of a ceiling trim molding in closed position showing left and right end caps which are used to close either hollow end of the trim member

Seen in FIG. 5A is a section of ceiling trim molding 12 illustrating the use of a righthand end cap 128 and a lefthand end cap 130 which may be used to close the open end of the ceiling trim molding as for example where it may be interrupted as at a door frame or window. Each of end caps 128, 130 have a solid body panel with an outside surface 132 and an inside surface 134 having a peripheral edge 136. Peripheral edge 136 is contoured to the same general shape as the shape of the outside surface of the connecting panels of wall 40 of the ceiling molding or may be enlarged to have a slight uniform overhang all around the outside edge of wall 40.

The end caps have a wall 138 extending from the inside surface 134 of end caps 128, 130, which has an outer surface 140 shaped to fit the hollow 42 of ceiling molding 12 in at least partial contact with the inside surface of the panels made from wall 40. These are made in left and right hand versions shaped to fit the corresponding left and right hand openings at the opposite ends of ceiling trim molding 12 and for insertion therein. When the end caps are inserted in the end or ends of molding 12, the wall 138 is hidden from view and may be sized to provide a snug fit with the squared-off edge of trim molding 12 at its open end so as to hold the end cap in place, or the end cap may be glued in place.

In view of the accessability provided by the pivoting decorative panel 38, it is even possible to fasten a screw through a part of wall 138 into the edge of panel 44 to hold the end cap in place. When panel 38 is snapped shut to the closed position, any such screws and the wall 138 will be covered from view. Left and right end caps are in effect mirror images of each other in the same manner as are the inserts or adapters 102 on the junction members 20, 22 because the inserts will fit on opposite ends of trim members as they go from corner to corner between junction members.

Figure 6:
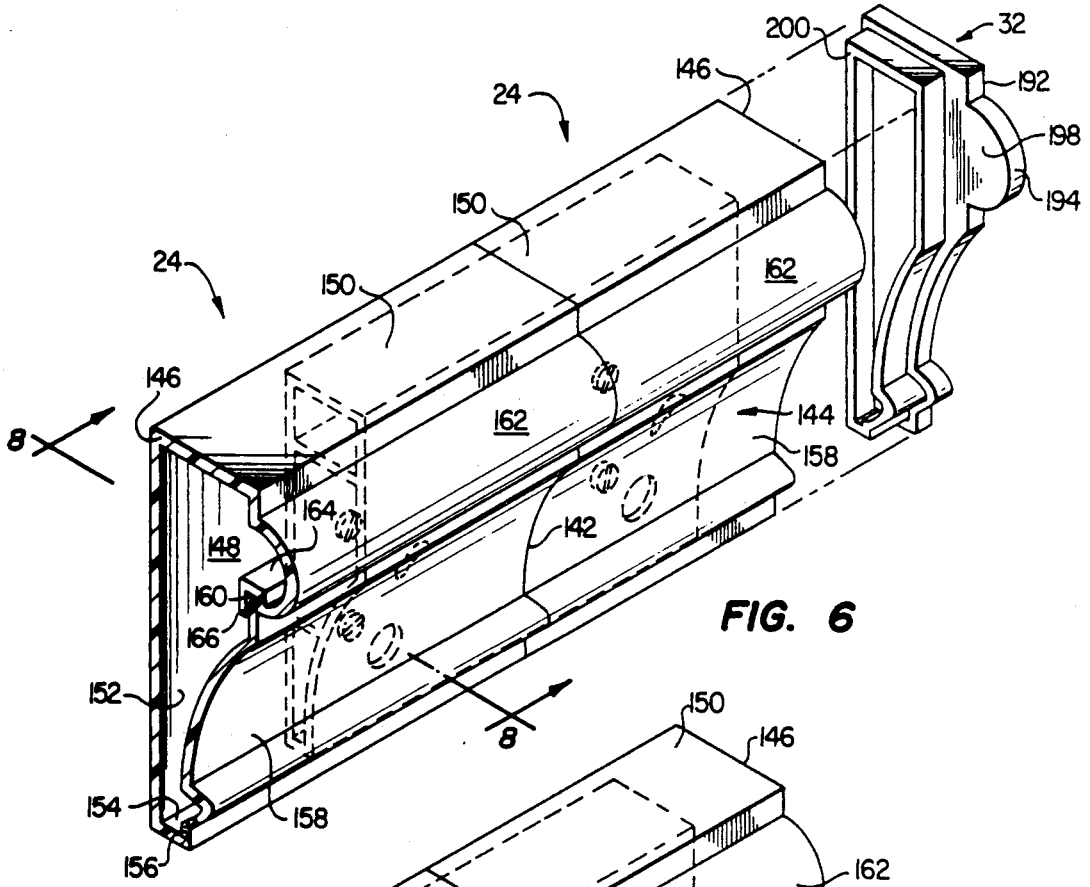
FIG. 6 is a perspective view of a chair rail trim assembly butt splice where the mating ends of two chair rail trim members are each butted together over half of a chair rail splice member in phantom as it would appear on a wall surface and also showing an end cap to close the open hollow end of a chair rail trim member.
Figure 7:
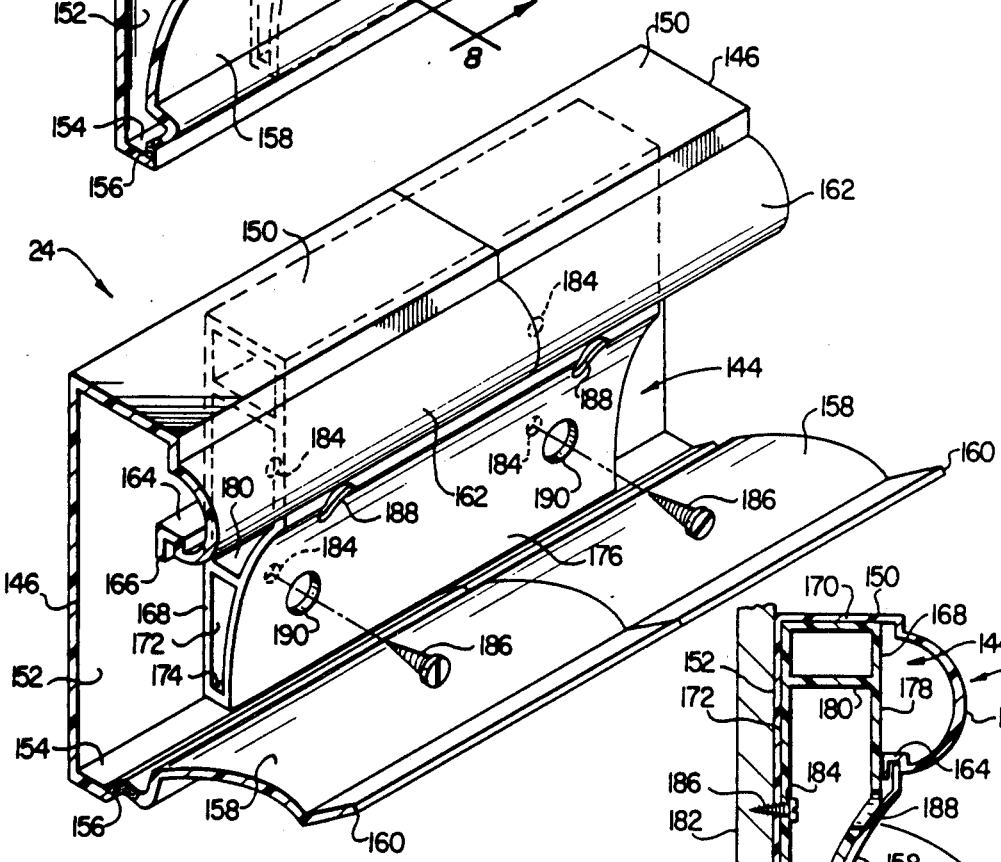
FIG. 7 shows the splice member of FIG. 6 under each of the pivotable decorative panels of the respective chair rail trim members which are similarly pivoted to the open position and detailing the fasteners which fix the butt joints to a wall and which are covered when the decorative panels are pivoted back to the position of FIG. 6.
Figure 8:
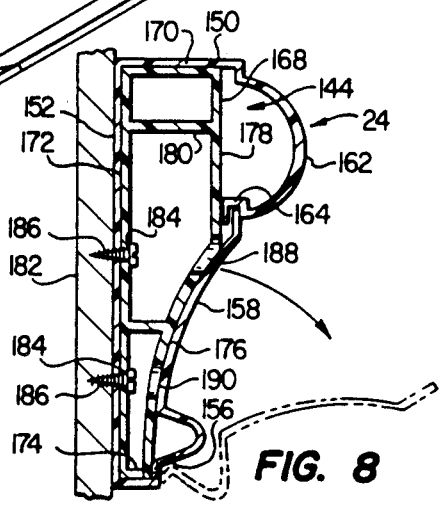
FIG. 8 is a cross-section of the butt splice of FIG. 6 on the line 8—8 fastened to a vertical wall and illustrating in phantom the decorative panel pivoted to the open position.

In FIGS. 6, 7 and 8 are shown a butt joint made between the squared-off mating ends of the abutted hollow chair rail trim members 24 abutted along butt joint line 142, the ends of which cover chair rail splice member 144. In FIG. 6, chair rail splice member 144 is seen in dotted lines, is partly exposed in FIG. 7 and is seen in cross-section in FIG. 8.

Chair rail trim members 24 are formed from a wall 146 forming a series of interconnected panels having a uniform cross-section along its length. The panels may be defined by a change in direction of the wall 146 which is continuous except at its opposite ends where they come together adjacently as will be described. Each chair rail trim member 24 has a top panel 150 which is shown flat but could be arcuate or some other shape as long as it does not interfere with the positioning of splice member 144 inside hollow 148 defined by wall 146. Panel 150 continues through a change of direction to a flat back panel 152 which in use position will be oriented vertically and having its outer or rearwardmost surface against and in contact with a vertical wall intermediate the floor and ceiling, said chair rail trim member being oriented in horizontal position along its imaginary central axis running from end to end on a line parallel to the arrows denoting FIG. 8. The assembly will be described in relation to its position of use shown in FIG. 11.

Assuming panel 152 to be mounted against the wall surface, it continues through a change of direction away from the wall as bottom panel 154 which has a means for hinging 156 which joins it to a decorative front panel 158 pivotable between an open position and a closed position, which terminates at an edge 160. Means for hinging 156 is a hinge connecting pivotable decorative panel 158 to panel 154 along the edge of panel 154 spaced away from panel 152 in the position shown in FIGS. 6–8 and running continuously in the same position along the length of chair rail trim member 24. Hinge 156 is preferably a "living hinge" in and made as a part of wall 146 by co-extruding as flexible plastic to constitute hinges 156 which is indicated by means of the stippled area in FIGS. 6–8, the rest of wall 146 being coextruded of a harder, less flexible plastic with greater strength and rigidity.

Top panel 150 extends away from panel 152 towards the decorative front of chair rail trim member 24 and is joined through another change of direction of wall 146 to a decorative chair bumper panel 162 spaced away from the back panel and terminating at a releaseable means for holding 164 which is shaped as an integral part of wall 146 in position to catch and hold edge 160 of decorative panel 158 when it is pivoted to the closed position shown in FIG. 6. The means for holding is releaseable because wall 146 through more rigid than hinge 156 still has some flexibility which by application of hand force allows edge 160 to bend slightly and release from means 164 so that it may be pivoted to the open position of FIG. 7. Means for holding 164 terminates in edge 166 which is the opposite extremity of wall 146 opposite from edge 160 and in the closed position is adjacent to it.

Chair rail splice member 144 is akin to ceiling trim splice member 60 and performs similar functions for the chair rail trim members. Splice member 144 is formed by a wall 168 defining interconnected panels at changes of direction. Chair rail splice member 144 is preferably formed in long lengths of uniform cross-section which are cross-cut to appropriate splice-making size. Wall 168 forms an interconnected series of panels and is shaped to fit inside the hollow 148, half in the hollow mating end of each abutted chair rail trim member 24 as best seen in FIG. 8. Wall 168 forms a top panel 170, a flat back panel 172, bottom panel 174, a front decorative support panel 176, and a bumper panel 178, which together with one or more panel stiffeners 180 form splice member 144.

FIG. 8 shows how the splice member fits inside a trim member 24 as mounted in position for use horizontally on the surface of wall or partition 182, the viewing axis being horizontal. Back panel 172 is in contact with and receives positioning support from panel 152 of the chair rail trim member which in turn is supported by the wall structure in contact with it. Front decorative support panel 176 is spaced away from back panel 172 and is curved to at least partially support and position decorative front panel 158 of a given chair rail trim member 24 when it is in the closed position as illustrated in FIG. 8.

Paired cut-outs 188 and 190, one set for each end of the splice member, are provided generally in line with fastener openings 184 in the back panel 172, whereby mounting is accomplished by shooting fasteners 186 through panel 172, then through panel 152 and on into the supporting vertical wall. This is accomplished as indicated in FIG. 7 with the decorative front panels 158 pivoted to the open position with half the splice member inside the butted ends of two chair rail trim members. Top panel 170 of the splice member in contact with the inside surface of panels 150 controls the location of the abutment edge 142 at the top of the assembly. Back panel 172 in contact with panels 152 and decorative support panel 176 controls the location of the abutting edges of decorative front panels 158 of the two abutting chair rail trim members. Panel 178 may help support the bumper panel 162 by preventing too much inward movement of the means for holding 164. Thus, a neat butt joint is formed with even registration of the edges in a smooth continuation of the surfaces along the chair rail trim members which are joined.

FIG. 6 also shows the use of an end cap which may be used for the chair rail trim member ends adjacent a doorway or other opening. The end caps are made in righthand and lefthand versions for the opposite ends of a chair rail trim member. Righthand end cap 32 has a flat end panel 192 having a peripheral edge 194 which is shaped to match the outside contours of a chair rail trim member 24 or slightly overhang it so that it may be assembled in position for use on a wall. Extending from one surface of panel 192, in this case surface 198, is a hollow wall 200 forming interconnected panel surfaces which correspond in shape to the shape of the hollow 148 inside chair rail trim member 24, to a sufficient degree to cause peripheral edge 194 to line up with the outside surfaces of the end of the chair rail trim member 24 in even register therewith, when assembled. Cap 32 may be held in place by friction fit between outside surfaces formed by wall 200 and inside surfaces formed by wall 146 or it may be glued in place or even connected with fasteners as was described earlier in connection with the end cap for ceiling trim moldings.

Figure 9:
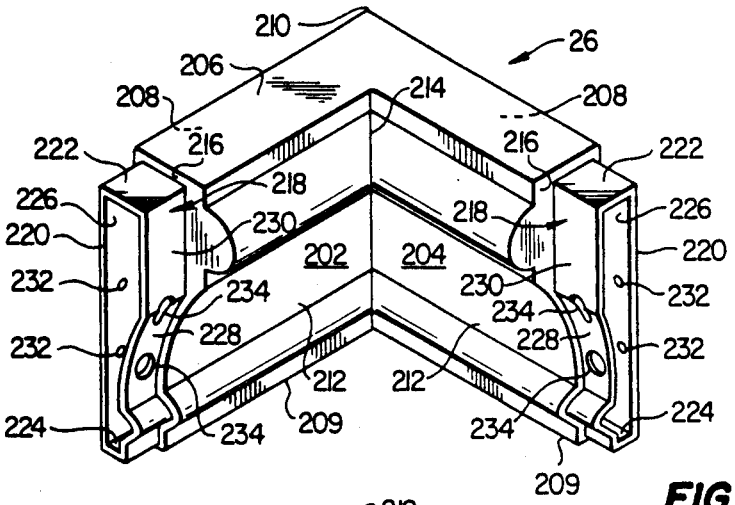
FIG. 9 is a perspective view of a chair rail corner body with right angularly related arms having intersecting room facing decorative panels, each having chair rail trim member adapters extending therefrom.
Figure 10:
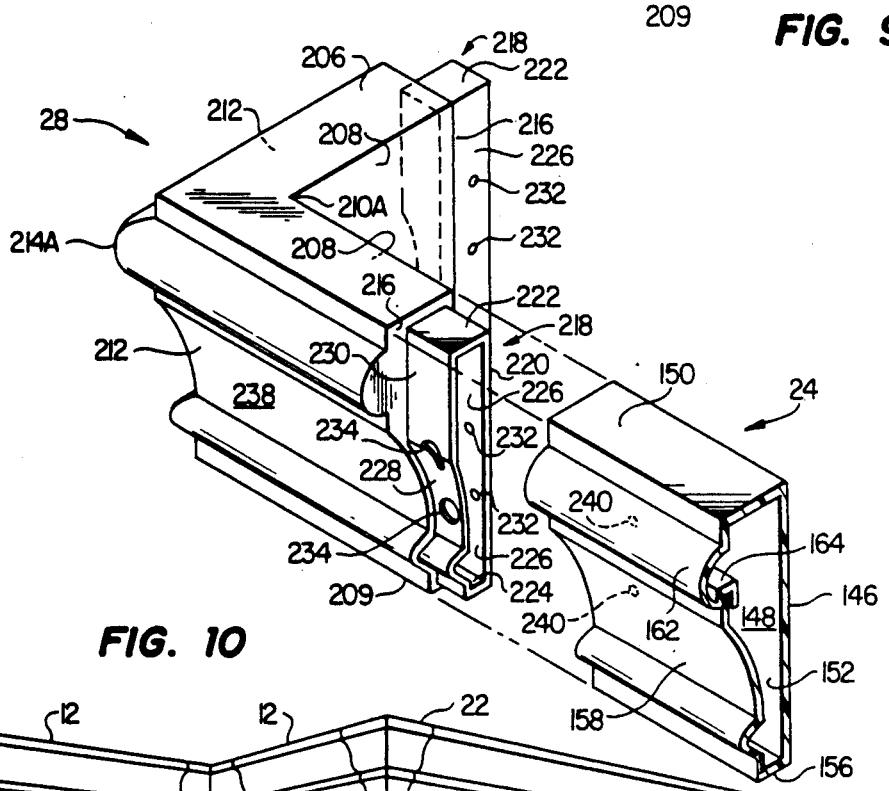
FIG. 10 is a perspective view of an outside chair rail corner body showing the room facing decorative surface and a chair rail trim member adapter on each arm, one of which illustrates how a chair rail trim member slips over the adapter to make a neat butt splice up against the edge of the corner body.

FIGS. 9 and 10 represent inside and outside chair rail corner bodies 26 and 28 respectively, which are used to interconnect horizontally mounted chair rail trim member 24 at corners along intersecting walls or partitions in position for use as indicated in FIG. 11. Each of the corner bodies have like right-angularly arranged arms forming the body, which in position for use extend horizontally, each along a vertical wall surface of the intersecting walls at a corner.

In FIG. 9, the corner body 26 has like equal arms 202 and 204 having right-angularly related intersecting surfaces. The body has a flat upper surface 206 which matches surface 150 of the chair rail trim member whatever its shape. For example, the upper surfaces could be a matching convex arcuate shape because this surface is not required to rest against the ceiling as is the flat surface at the top of a corner cap junction member previously described. (The shape of the splice members would have to be altered also).

In FIG. 9, each of the arms of corner body 26 have a back surface 208 which intersect at a first junction line 210. They have decorative surfaces 212 which intersect at a second junction line 214, spaced away from the first junction line by the thickness of the body. Flat top surface (horizontal) 206 and a hidden flat bottom surface 209 (horizontal) separate the decorative surfaces 212 spaced apart from the back surface 208 by the thickness of the body, it being understood that the body is preferably made hollow for economy and ease of molding.

Each of said arms terminate at an abutment edge 216 which has a fixed chair rail trim adapter, each extending therefrom in the direction of an imaginary axis to each arm. In position of use the axis may be said to be horizontal and parallel to a respective wall surface. The insert adapters are separately denominated by the reference numeral 218. They are left and right handed as they appear on the corner body but they have exactly the same construction and crosssection If the adapters were cut off at abutment edge 216 and the cut-off edges mated together, the cross-sections will exactly match each other.

The adapters of a corner body accomplish the same purpose for the opposite ends of a chair rail trim member, each fitting accordingly into the hollow end of a chair rail trim member, each in the opposite end of a chair rail trim member. With corner bodies 26 located in position for use at opposite corners along a wall it is seen that one end of a chair rail trim member would mount over the adapter on an arm 204 and its opposite end would fit over an adapter on an arm 202.

Insert adapters 218 are formed by a wall which forms interconnected panels including a top panel 222 and a bottom panel 224 spaced apart by a back panel 226 and a decorative support panel 228 and a bumper panel 230, the bumper panel and decorative support panel being joined and spaced apart from the back panel by the top and bottom panels. Insert adapters 218 are shaped just like the splice member 144 without the stiffeners 180, although the wall of the adapter 218 could include appropriately located stiffeners if desired. Adapters 218 further include fastener openings 232 in the back wall, each of which has a cut-out opening 234 oppositely located in the opposite panels of insert adapter 218 as shown in FIGS. 9 and 10.

The insert adapters 218 are shaped to fit in supporting contact inside the hollow 148 of a squared-off end of a chair rail trim member 24 in the same way that the chair rail splice member 144 fits inside the end of a chair rail trim member as is illustrated in FIGS. 6–8. The panels making up this insert adapter 218, except for panel 230, have surfaces which are parallel to corresponding surfaces on the arm of a corner body 26, 28 except that those panels are offset at the abutment edge 216 by at least the thickness of the wall 146 of chair rail trim member 24 everywhere around the abutment edge, the offset being equal to the thickness of wall 146 for panels 222 and 226 and at least part of panel 228 in order to provide support for and position chair rail trim member 24 when it is slipped over the insert adapter with its edge abutted against the abutment edge 216 all around. Then the edge of the abutting surfaces of the arm of a corner body member and the corresponding surfaces of the panels of the chair rail trim member are in even registration at the abutment edge, with the chair rail trim member in closed position, to give the appearance of a smooth continuous decorative surface along both walls and through the corner when corner body 26 or 28 are mounted at a corner with a chair rail trim molding along each wall mounted over each of the insert adapters and mated with abutment edges 216.

FIG. 10 shows chair rail corner body 28 for an outside corner having like right-angularly arranged arms 236, 238 forming the body, each of which has a wall contacting surface 208 which meet at a first junction surface 210A which, when the corner body is installed at a corner in a position for use will be located at the corner with wall contacting surfaces 208 in contact with the intersecting walls on either side of the corner. Similarly, the decorative room facing surfaces 212 of corner member 28 angularly intersect at a second junction line 214A which is spaced away from first junction line 210A by the thickness of the corner body with the decorative surfaces 212 facing away from the corner and into the room as before. Arms 236 and 238 terminate at abutment edge 216, arm 238 corresponding in shape, design, and construction to arm 204 of FIG. 9 and arm 236 corresponding in shape, design, and construction to arm 202 except that it is turned 180 degrees from the position of arm 202 in FIG. 9.

Each of the arms 236, 238 terminate at an abutment edge 216 as before so that abutment edge having insert adapter 218 afixed thereto and extending therefrom in exactly the same manner and for exactly the same purpose as the insert adapters 218 of FIG. 9.

As seen in FIG. 10, insert adapter 218 has a wall 220 forming panels which fit into hollow 148 when chair rail trim member 24 is placed over it with its squared-off edge butted against the abutment edge 216. In assembly, the panels 222, 226 and at least part of panel 228 on insert adapter 218 are in supporting contact respectively with the inside surfaces of panels 150, 152 and at least part of panel 158 with the end of chair rail trim member 24 mounted in place over insert adapter 218.

Mounting is accomplished by pivoting decorative panel 158 to the open position and with the trim member in place over the insert a screw and the end of a screwdriver are placed through cut-outs 234 then through the opposite opening 232 in the back panel of the insert adapter then through back panel 152 of a chair rail trim member, which may be equipped with appropriately located openings 240 then fixed into the wall. Insert adapters extending from each arm of a corner body are used in this way to mount the corner member and one end of the abutted trim member securely to the surface of intersecting walls at a corner, the insert positioning and supporting the end of the trim member so that the corresponding decorative surfaces of the corner body and the trim member form a smooth continum without a noticeable and objectionable step at the abutment edge where the surfaces meet.

After mounting pivotable panel 158 is pivoted to the closed position which completely hides from view the mounting fasteners and the contained insert adapter. Portions of panel 230 may provide additional positioning support for portions of the inside surfaces of the bumper panel 162 and/or the releaseable means for holding 164. The net effect is that the visual integrity of the butt joint between the arm of a corner body and a chair rail trim member is not entirely dependent upon having a smooth planar surface of at the intersecting walls or upon having a perfect corner. The insert serves to support the chair rail trim member in even registration in spite of some irregularities in the walls and corner.

Figure 12:
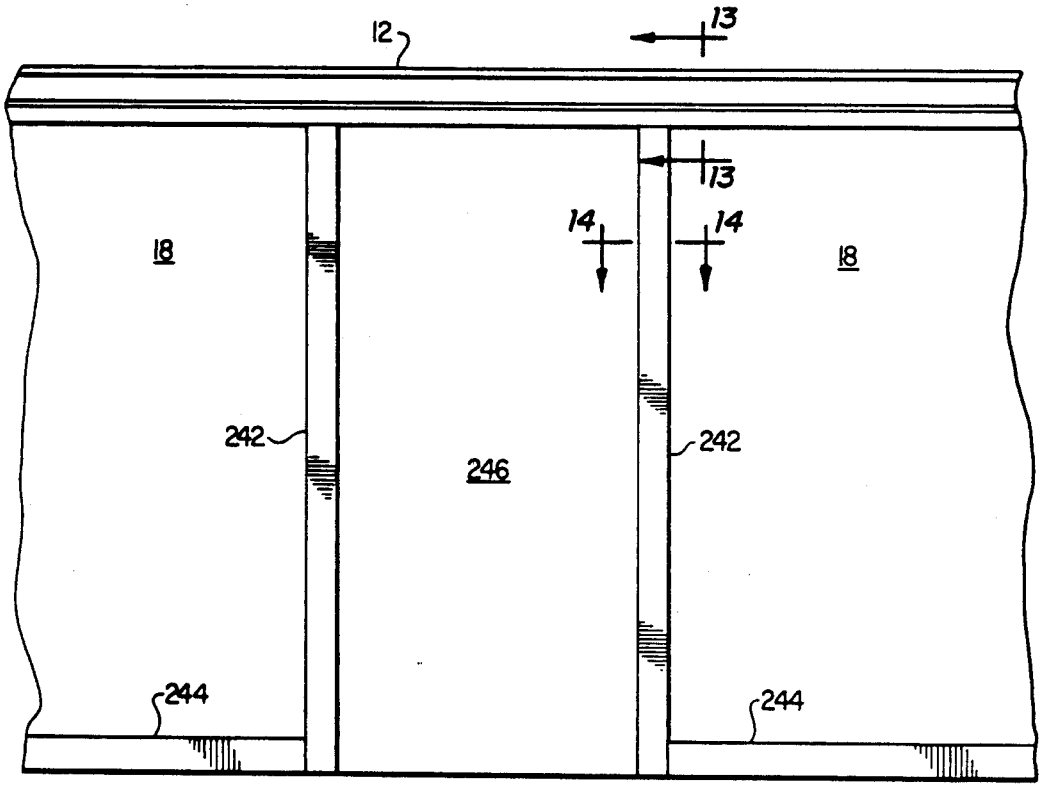
FIG. 12 is an elevation view of a wall having a full height doorway with the ceiling-wall molding across the top used in conjunction with vertical jam trim members.
Figure 13:
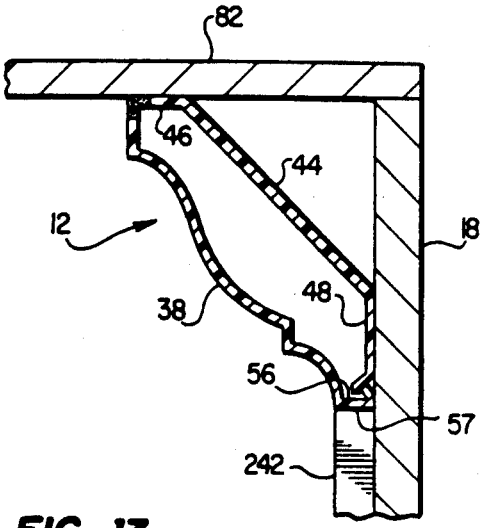
FIG. 13 is a cross-section of FIG. 12 on line 13—13 showing the junction between a ceiling trim molding and the vertical door jam trim.
Figure 14:
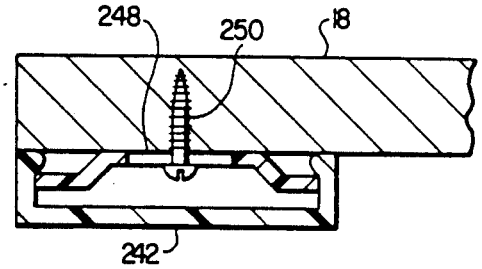
FIG. 14 is a cross-section of the vertical door jam trim of FIG. 12 on line 14—14 showing the details of installation.

FIGS. 12–14 illustrate another advantage of the present invention which eliminates multiple unsightly joints at the top of a full length door opening in a partitioned wall. Frames for supporting doors commonly have vertical members along the side of the door opening with a header across the top of the door running horizontally and perpendicular to the vertical door frame jam members. The trim for the junction between ceiling and walls frequently must end at the vertical door jam because the door jam extends out of the wall surface. Consequently, the trim is broken at that point, and in addition, there are frequently 45 degree mitered cuts at the upper ends of the vertical jam trim members where they meet with the horizontal header leaving an unsightly joint.

In FIG. 12 a full-length door opening 246 is seen in wall partition 18. A horizontal ceiling-wall trim molding 12 is seen running across the top of the door opening. It is mounted to the wall and ceiling as described herein. Vertical trim jam members 242 are mounted alongside the opening and meet the bottom of trim molding 12. Trim jam member 242 extends downward to a baseboard 244.

In FIG. 13 is seen a cross-section of the installation of FIG. 12 with trim member 12 being mounted in position with panel 46 in contact with the surfaces of wall 82 and panel 48 in contact with the surface of wall 18. Trim jam member 242 is shown butted against that portion of decorative panel 38 of trim molding 12 which is formed into releaseable means for holding 56 having a flat bottom 57, trim jam member 242 being selected to stand out from the wall that same distance so as to provide a neat appearing joint. Trim jam member 242 is further described in my U.S. Pat. No. 4,642,957 issued Feb. 17, 1987, where it may be referred to as a cap member.

In FIG. 14, more details of trim jam member 242 are seen, trim jam member 242 being secured by means of a retainer member 248 and fastener 250 to wall 18.

Returning to FIG. 12, it can be seen that trim molding 12 can be used to hide the unsightly joints of a door frame header and its ease of removeability feature allows the door frame and door to be adjusted or maintained without destruction of the molding.

Corner cap junction members and the chair rail corner bodies are preferably molded by the injection molding process as hollow bodies in one piece. This adds to the economy of the part because it requires less material and less fabrication. Hollow construction adds to dimensional control and reduces the chances of defects in the decorative surfaces due to such things as shrinkage. High impact polyvinylchloride (PVC) is believed to be a suitable molding material useful in the molding process in accordance with the usual standards of that art. The molding compound should be capable of accepting integrally mixed colorants which will survice the molding process. Molding compounds should be of plastic material selected for impact resistance and rigidity without brittleness.

The ceiling trim moldings 12 and the chair rail trim moldings 24, along with the respective splice members are preferably made of PVC plastic in long lengths by the extrusion process for economy and dimensional control. The plastic selected should have impact resistance and rigidity without being brittle. Again, integral colorants are to be selected to match the color of the corner pieces. Trim members 12 and trim moldings 24 are preferably made by simultaneously extruding two plastics using the coextrusion process known in the art. The respective pivoting hinge members 50 and 156 are preferably made as living hinges integral with the rest of the wall forming the parts. The plastic selecting for coextrusion of the means for hinging should have sufficient flexibility to allow repeated pivoting of the decorative surface 38 and the decorative surface 158 between the open and the closed position. The remainder of the wall of molding 12 and trim member 24 is coextruded with a plastic selected to have greater hardness and more rigidity with less flexibility than that used in the living hinges. A suitable selection of plastics with these characteristics and with proper hot extrusion characteristics is believed to be known in the plastic extruding art.

It is also understood that trim molding 12 and trim member 24 could be made as two separate parts with some form of conventional hinge being used by connecting the two halves at the place shown (as stippled)

on the drawings for the location of hinge 50 and hinge 156 to provide a pivoting action for the decorative panels. It is also understood that the location of the releaseable means for holding 56 and hinge 50 of trim molding 12 or the releaseable means for holding 164 and hinge 156 in trim member 24 could be reversed so that pivoting occurs from the opposite end of the respective decorative panels so long as the decorative panels can be pivoted to a suitable open and closed position for the purpose of installation and removal.

In the foregoing detailed description, it will be evident that there are a number of changes, adaptions and modifications of the present invention which will come within the province of those persons having ordinary skill in the art to which the present invention pertains. However, it is intended at all such variations not departing from the spirit of the invention be considered within the scope thereof.

I claim:

1. In a room partition wall trim cap assembly for trimming the junction between wall panels and ceiling, the combination of at least two elongated hollow ceiling trim members each being openable and closeable between a closed position and an open position, and at least one insertable ceiling trim splice member which in at least partial supporting contact fits into a hollow end of each of two of said trim members to form a neat butt joint between one of the trim members and another of the trim members when a hollow end of said one trim member and a mating hollow end of said another trim member are each placed over a portion of said insert, abutted and closed to cover said insert from view.

2. The assembly of claim 1 wherein the trim members are formed of a series of connected panels including a flattened wall contacting panel and a flattened ceiling contacting panel joined by a back panel, one of said wall or ceiling connecting panels having a means for hinging at its extremity opposite where said one wall or ceiling panel is joined with said back panel, said means for hinging being hinged to a decorative front panel having an edge, the edge of said decorative front panel having a releasable means for holding to a shaped extension of the other of said one wall or ceiling contacting panel when the trim member is in the closed position.

3. The assembly of claim 1 wherein trim members are further defined as having a decorative front panel spaced apart from a back panel by wall and ceiling contacting extensions of said back panel angled to lie flat in contact with a wall surface and a ceiling surface respectively, when the trim member is positioned for use, wherein the decorative front panel has means for pivoting connected along a hinge line to one of said wall or ceiling extensions, by a means for pivoting, in order to open the trim member for installation, said decorative front panel having an edge located away from said pivotal means, said edge having a releasable means for holding which connects the decorative panel to the other of said back panel wall or ceiling contacting extensions when the trim member is closed after installation.

4. In a room partition wall trim cap assembly for trimming the junction between wall panels and ceiling, the combination of at least two elongated hollow ceiling trim members each being openable and closeable between a closed position and an open position, and at least one insertable ceiling trim splice member which in at least partial supporting contact fits into a hollow end of each of two of said trim members to form a neat butt joint between one of the trim members and another of the trim members when a hollow end of said one trim member and a mating hollow end of said another trim member are each placed over a portion of said insert, abutted and closed to cover said insert from view;

the assembly further including an end cap for the squared off open end of a ceiling trim member in closed position, the end cap having a body panel with a periferal edge contoured to the general shape of the trim member cross section, the end cap having a wall portion extending from the body panel, shaped to insert snugly, hidden from view inside the hollow end of the trim member in at least partial supporting contact thereof, when installed to cap the end of a trim member.

5. The assembly of claims 1 or 2 or 3 or 4 wherein said trim members and said splice member are formed from extruded plastic.

6. The assembly of claim 2 or 3 wherein the insertable splice member has a portion adapted to contact and receive support from the back panel inside any trim member, said member having supporting extension projecting toward and in supporting contact with a portion of the decorative front panel intermediate the means for pivoting and the means for holding.

7. The assembly of claim 6 wherein the trim members and splice member are formed of extruded plastic.

8. The assembly of claim 6 further including an end cap for the squared off open end of a ceiling trim member in closed position, the end cap having a body panel with a periferal edge contoured to the general shape of the trim member cross section, the end cap having a wall portion extending from the body panel, shaped to insert snugly, hidden from view inside the hollow end of the trim member in at least partial supporting contact thereof, when installed to cap the end of a trim member.

9. In a room partition wall trim cap assembly for trimming the junction between wall panels and ceiling, including a vertical wall corner, the combination of a corner cap junction member and at least one elongated hollow ceiling trim member with a decorative face being openable and closeable for installation between an open open position and a closed position, said corner cap junction member being a hollow body with right angularly related intersecting surfaces on wall extending portions and having a flat ceiling contacting surface across the top of the body; each wall extending portion having a wall contacting surface which rests against the walls in a corner when the body is positioned for use in a corner with the top surface of the body against the ceiling; each wall extending portion having a decorative facing surface matching the decorative front panel of said trim members, visible when the body is in said position for use, and each wall extending portion also having a ceiling trim member insert extension shaped to fit the hollow inside the trim member in at least partial support of the decorative face of a trim member when the hollow end of a trim member is mounted over said insert in position for use, said insert extension being adapted to locate the edge of the abutting decorative facing surface of said trim member and a decorative facing surface of the corner cap junction member in even registration to form a neat joint with said trim member closed to cover said insert extension after installation.

10. The assembly of claim 9 wherein the trim members are formed of a series of connected panels including a flattened wall contacting panel and a flattened ceiling contacting panel joined by a back panel, one of said wall or ceiling connecting panels having a means for hinging at its extremity opposite where said one wall or ceiling panel is joined with said back panel, said means for hinging being hinged to a decorative front panel having an edge, the edge of said decorative front panel having a releasable means for holding to a shaped extension the extremity of the other of said one wall or ceiling contacting panel when the trim member is in the closed position.

11. The assembly of claim 9 wherein trim members are further defined as having a decorative front panel spaced apart from a back panel by wall and ceiling contacting extensions of said back panel angled to lie flat in contact with a wall surface and a ceiling surface, respectively, when the trim member is positioned for use, wherein the decorative front panel has means for pivoting connected along a hinge line to one of said wall or ceiling extensions, by a means for pivoting, in order to open the trim member for installation, said decorative front panel having an edge located away from said pivotal means, said edge having a releasable means for holding which connects the decorative panel to the other of said back panel wall or ceiling contacting extensions when the trim member is closed after installation.

12. The assembly of claims 9, 10 or 11 wherein the corner cap junction member is formed from plastic and the at least one trim member is shaped from extruded plastic.

13. In a room partition wall trim cap assembly for trimming the junction between wall panels and ceiling and continuing the trim along one wall, through a corner and along the other wall, the combination of an elongated hollow ceiling trim member for each wall of the corner, said trim member having at least a flat ceiling contact panel and a flat wall contact panel in right angle relation to each other and separated by a panel angularly connected therebewtween, the ceiling trim member further having a pivotable decorative front panel spaced apart from said back panel and connected to the ceiling contacting panel by means for hinging and having in opposite location releaseable means for holding to said wall contacting panel, said decorative panel being pivotable between an open position and a closed position and being visible to trim the junction when the contact panels are mounted in contact with a respective ceiling and wall; and a corner cap junction member having a hollow body with like right angled arms, said body being adapted to mount in the corner with a flat ceiling contact surface extending along each arm and a flat wall contact surface extending along each arm, said flat ceiling and wall contact surfaces being connected by a decorative front surface extending along each arm, said surfaces terminating at an abutment edge beyond which extends a trim member insert shaped to fit inside the hollow end of a trim member in at least partial support when a ceiling trim member is placed over said insert with its end in contact with said abutment edge, one for each arm, said abutment edge being offset corresponding to the thickness of the respective trim member decorative panel to form an neat even joint around the corner from a ceiling trim member on said one wall through said corner cap member to a ceiling trim member on said other wall when said assembly is mounted for trimming.

14. The assembly of claim 13 wherein the trim members are formed of a series of connected panels including a flattened wall contacting panel and a flattened ceiling contacting panel joined by a back panel, one of said wall or ceiling connecting panels having a means for hinging at its extremity opposite where said one wall or ceiling panel is joined with said back panel, said means for hinging being hinged to a decorative front panel having an edge, the edge of said decorative front panel having a releasable means for holding to a shaped extension of the other of said one wall or ceiling contacting panel when the trim member is in the closed position.

15. The assembly of claim 13 wherein trim members are further defined as having a decorative front panel spaced apart from a back panel by wall and ceiling contacting extensions of said back panel angled to lie flat in contact with a wall surface and a ceiling surface, respectively, when the trim member is positioned for use, wherein the decorative front panel has means for pivoting connected along a hinge line to one of said wall or ceiling extensions, by a means for pivoting, in order to open the trim member for installation, said decorative front panel having an edge located away from said pivotal means, said edge having a releasable means for holding which connects the decorative panel to the other of said back panel wall or ceiling contacting extensions when the trim member is closed after installation.

16. In a room partition wall trim cap assembly for trimming the junction between wall panels and ceiling and continuing the trim along one wall, through a corner and along the other wall, the combination of an elongated hollow ceiling trim member for each wall of the corner, said trim member having at least a flat ceiling contact panel and a flat wall contact panel in right angle relation to each other and separated by a panel angularly connected therebetween, the ceiling trim member further having a pivotable decorative front panel spaced apart from said back panel and connected to the ceiling contacting panel by means for pivoting and having in opposite location releaseable means for holding to said wall contacting panel, said decorative panel being pivotable between an open position and a closed position and being visible to trim the junction when the contact panels are mounted in contact with a respective ceiling and wall;

a corner cap junction member having a hollow body with like right angled arms, said body being adapted to mount in the corner with a flat ceiling contact surface extending along each arm and a flat wall contact surface extending along each arm, said flat ceiling and wall contact surfaces being connected by a decorative front surface extending along each arm, said surfaces terminating at an abutment edge beyond which extends a trim member insert shaped to fit inside the hollow end of a trim member in at least partial support when a ceiling trim member is placed over said insert with its end in contact with said abutment edge, one for each arm, said abutment edge being offset corresponding to the thickness of the respective trim member decorative panel to form an neat even joint around the corner from a ceiling trim member on said one wall through said corner cap member to a ceiling trim member on said other wall when said assembly is mounted for trimming; and, the corner cap junction member is formed from plastic and at least one trim member is shaped from coextruded plastic of one flexibility wherein the means for pivoting is integrally formed in coextrusion of plastic having a greater flexibility than the flexibility of the trim member proper.

17. In a wall partition chair rail trim assembly the combination of at least two elongated hollow chair rail trim members each having a pivotable decorative panel pivotable between an open position for installation and a closed position for use, and at least one chair rail splice member which in supporting contact fits into a hollow end of each of two of said chair rails to form a neat butt joint between one of the chair rail trim members and another of the chair rail trim members when a hollow end of said one chair rail trim member and a mating hollow end of said another chair rail trim member are each placed over a portion of said splice member and abutted to cover said splice member insert from view.

18. The chair rail trim assembly of claim 17 wherein the chair rail trim members further comprise a formed wall enclosing the hollow and including a flat back panel for mounting against a wall, the formed wall continuing away from the back panel through a change of direction defining one end of said back panel to form a decorative chair bumper spaced away from the back panel and terminating at a means for releasably holding a pivotable panel, said wall continuing from the other end of said back panel, defined by another change of direction, to a means for pivoting connected to the pivotable decorative panel, said pivotable decorative panel having an exposed edge engageable by the means for releasably holding and being releasable to the open position for installation or removal.

19. The chair rail trim assembly of claim 17 or 18 wherein said chair rail trim members are formed of extruded plastic.

20. The chair rail trim assembly of claim 17 or 18 wherein the splice member has at least a portion adapted to contact and receive positioning support from the back panel inside any chair rail trim member, said splice member further projecting toward and in supporting contact with at least a portion of said pivotable decorative panel.

21. The chair rail trim assembly of claim 20 wherein said chair rail trim members are formed of extruded plastic.

22. In a wall partition chair rail trim assembly the combination of at least two elongated hollow chair rail trim members each having a pivotable decorative panel pivotable between an open position for installation and a closed position for use, and at least one chair rail splice member which in supporting contact fits into a hollow end of each of two of said chair rails to form a neat butt joint between one of the chair rail trim members and another of the chair rail trim members when a hollow end of said one chair rail trim member and a mating hollow end of said another chair rail trim member are each placed over a portion of said splice member and abutted to cover said splice member insert from view;

wherein the chair rail trim members further comprise a formed wall enclosing the hollow and including a flat back panel for mounting against a wall, the formed wall continuing away from the back panel through a change of direction defining one end of said back panel to form a decorative chair bumper spaced away from the back panel and terminating at a means for releasably holding a pivotable panel, said wall continuing from the other end of said back panel, defined by another change of direction, to a means for pivoting connected to the pivotable decorative panel, said pivotable decorative panel having an exposed edge engageable by the means for releasably holding and being releasable to the open position for installation or removal;

the splice member having at least a portion adapted to contact and receive positioning support from the back panel inside any chair rail trim member, said splice member further projecting toward and in supporting contact with at least a portion of said pivotable decorative panel; and, said chair rail trim members being shaped from coextruded plastic of one flexibility wherein the means for pivoting is integrally formed in coextrusion of plastic having a greater flexibility than the flexibility of the plastic making up the chair rail trim member proper.

23. In a room partition wall trim chair rail assembly for trimming along wall surfaces through a corner where walls intersect, the combination of a decorative chair rail corner body and at least a decorative hollow chair rail trim member formed with a wall defining a decorative room facing surface when said assembly is positioned for use and having a uniform cross-section along its length, said corner body having like right angularly arranged arms forming the body, each of which has a wall contacting surface which meet at a first junction which, when the corner body is installed at the corner in a position for use will be located at the corner, being oriented so that one of said arms extends along each wall surface and in contact with it; opposite said wall contacting surfaces, the chair rail corner body has angularly related intersecting room facing decorative surfaces matching the decorative surface of said trim member, joined at a second junction and facing away from the corner when in position for use, said second junction being spaced away from said first junction by the thickness of the body; each of said arms terminates at an abutment edge having a chair rail trim member adapter extending therefrom, each adapter having a wall defining the outer surface of the adapter including a portion shaped to match the contour of a portion of the decorative surface of the chair rail corner body, said adapter wall being offset inwardly on the abutment surface by about the thickness of the wall of said chair rail trim member at said portion of the decorative surface, said wall being similarly offset at sufficient other places around said edge to provide support for the wall of the hollow end of a chair rail trim member, in even registration with at least the decorative surface of an arm of the chair rail corner body, when an end of said trim member is mounted over one of said adapters with the trim member in closed position abutting said abutment edge of said arm and hiding said adapter from view.

24. An interior wall partition trim assembly for providing a decorative trim molding at the ceiling-wall junction and corners together with a decorative chair rail trim member for trimming walls and corners intermediate the ceiling and floor, the combination of ceiling trim splice members shaped to fit supportingly inside the abutted ends of elongated hollow ceiling trim moldings and chair rail trim splice members shaped to fit inside the abutted ends of hollow chair rail trim members to position the respective abutted ends in even registration when fastened to a ceiling junction and wall, respectively, said splice members and mounting fasteners being accessible for mounting or demounting by pivotable decorative panels on each ceiling and chair rail trim member which close to hide the respective splice members and fasteners; including corner cap junction members having ceiling trim molding insert adapters and chair rail corner bodies having chair rail trim member insert adapters, respectively, extending from right angled arms of the junction members and corner bodies, said insert adapters being inwardly offset at an abutment edge from decorative surfaces on said arms matching decorative surfaces on the corresponding trim members when ends of said trim members are positioned to cover insert adapters in contact with an abutment edge, to provide a continuous appearing trim molding decorative surface along the ceiling-wall junction and a continuous appearing chair rail trim member decorative surface along two or more intersecting walls, said insert adapters being accessible for mounting and for demounting by the pivotable decorative panels on ceiling moldings or chair rail trim members which close to hide adapters and mounting fasteners; and further including end cap members for ceiling trim moldings and for chair rail trim members to close open ends not fastened to respective corner junction or corner body members.

25. In a complete room partition ceiling and wall trim assembly for trimming the junction between wall panels and ceiling, including a chair rail trim assembly for trimming the same walls intermediate the ceiling and floor, where the walls intersect to form a corner, the combination of an elongated hollow ceiling trim member for each wall of the corner, said trim members having at least a flat ceiling contact panel and a flat wall contact panel in right angle relation to each other and separated by a back panel angularly connected therebetween, the ceiling trim members further having a pivotable decorative front panel spaced apart from said back panel and connected to the ceiling contacting panel by means for hinging and having an oppositely located releaseable means for holding to said wall contacting panel, said decorative panel being pivotable between and open position and a closed position; a corner cap junction member having a hollow body with like right angled arms, said body being adapted to mount in the corner with a flat ceiling contact surface extending along each arm and a flat wall contact surface extending along arm, said flat ceiling and wall contact surfaces being connected by a decorative front surface extending along each arm, said surfaces terminating at an abutment edge beyond which extends a trim member insert adapter shaped to fit inside the hollow end of one of said trim members in at least partial positioning support when a ceiling trim member is placed over said insert with its end in contact with said abutment edge, one for each arm, said abutment edges being offset corresponding to the thickness of the respective trim member decorative panel to form a neat even joint with continuous appearing decorative surfaces extending around the corner from a ceiling trim member on said one wall through said corner cap member to a ceiling trim member on said other wall when the corner cap junction member is installed in the corner with a ceiling trim member mounted and installed to trim the ceiling-wall junctions; the combination further including at least a pair of chair rail trim members and a chair rail corner body, the chair rail trim members having a wall enclosing a hollow and including a flat back panel for mounting against a wall, the formed wall continuing away from the back panel from a change of direction defining one end of said back panel, to form a decorative chair bumper spaced away from the back panel and terminating at a means for releaseably holding a pivotable panel, said wall continuing from the other end of said back panel defined by another change of direction, to a means for pivoting connected to the pivotable decorative panel, said pivotable decorative panel having an exposed edge engageable by the means for releaseably holding and being releaseable to an open position for installation or removal and pivotable to a closed position for trimming; the corner body having like right-angularly arranged arms forming the body, each of which has a wall contacting surface which meets at a first junction which, when the corner body is installed at the corner in a position for use will be located at the corner, the body being oriented so that one of said arms extends along each wall surface and in contact with it, opposite said wall contacting surfaces, the chair rail corner body has angularly related intersecting room facing decorative surfaces matching the decorative surfaces of the chair rail trim members, joined at a second junction and facing away from the corner when in position for use, said second junction being spaced away from said first junction by the thickness of the body, each of said arms terminating at an abutment edge having a chair rail trim member adapter extending therefrom, each adapter having a wall defining the other surface of the adapter including a portion shaped to match the contour of a portion of the decorative surfaces of the chair rail corner body, said adapter wall being offset inwardly on the abutment surface by about the thickness of the wall of said chair rail trim member at said portion of the decorative surface, each wall being similarly offset at sufficient other places around said edge to provide support for the wall of the hollow end of a chair rail trim member, in even registration with at least the decorative surface of an arm of the chair rail corner body, when an end of one of said trim members is mounted over one of said adapters with the trim member in closed position abutting the abutment edge of said arm and hiding said adapter from view, the chair rail trim assembly extending horizontally along each wall and through the corner in position for use, the completed assembly having smooth continuous appearing decorative ceiling molding surfaces along the ceiling-wall junction and smooth continuous appearing decorative chair rail trim member surfaces extending along each wall and through the corner.

26. In a room partition wall trim cap assembly for trimming the junction between wall panels and ceiling, the combination of at least two elongated hollow ceiling trim members each being openable and closeable between a closed position and an open position, and at least one insertable ceiling trim splice member which in at least partial supporting contact fits into a hollow end of each of two of said trim members to form a neat butt joint between one of the trim members and another of the trim members when a hollow end of said one trim member and a mating hollow end of said another trim member are each placed over a portion of said insert, abutted and closed to cover said insert from view;

the trim members being formed of a series of connected panels including a flattened wall contacting panel and a flattened ceiling contacting panel joined by a back panel, one of said wall or ceiling connecting panels having a means for hinging at its extremity opposite where said one wall or ceiling panel is joined with said back panel, said means for hinging being hinged to a decorative front panel having an edge, the edge of said decorative front panel having a releasable means for holding to a shaped extension of the other of said one wall or ceiling contacting panel when the trim member is in the closed position;

the assembly further including an end cap for the squared off open end of a ceiling trim member in closed position, the end cap having a body panel with a periferal edge contoured to the general shape of the trim member cross section, the end cap having a wall portion extending from the body panel, shaped to insert snugly, hidden from view inside the hollow end of the trim member in at least partial supporting contact thereof, when installed to cap the end of a trim member.

27. In a room partition wall trim cap assembly for trimming the junction between wall panels and ceiling, the combination of at least two elongated hollow ceiling trim members each being openable and closeable between a closed position and an open position, and at least one insertable ceiling trim splice member which in at least partial supporting contact fits into a hollow end of each of two of said trim members to form a neat butt joint between one of the trim members and another of the trim members when a hollow end of said one trim member and a mating hollow end of said another trim member are each placed over a portion of said insert, abutted and closed to cover said insert from view;

the trim members having a decorative front panel spaced apart from a back panel by wall and ceiling contacting extensions of said back panel angled to lie flat in contact with a wall surface and a ceiling surface respectively, when the trim member is positioned for use, wherein the decorative front panel has means for pivoting connected along a hinge line to one of said wall or ceiling extensions, by a means for pivoting, in order to open the trim member for installation, said decorative front panel having an edge located away from said pivotal means, said edge having a releasable means for holding which connects the decorative panel to the other of said back panel wall or ceiling contacting extensions when the trim member is closed after installation;

the assembly further including at least one end cap for the squared off open end of a ceiling trim member in closed position, the end cap having a body panel with a periferal edge contoured to the general shape of the trim member cross section, the end cap having a wall portion extending from the body panel, shaped to insert snugly, hidden from view inside the hollow end of the trim member in at least partial supporting contact thereof, when installed to cap the end of a trim member.

28. In a room partition wall trim cap assembly for trimming the junction between wall panels and ceiling, the combination of at least two elongated hollow ceiling trim members each being openable and closeable between a closed position and an open position, and at least one insertable ceiling trim splice member which in at least partial supporting contact fits into a hollow end of each of two of said trim members to form a neat butt joint between one of the trim members and another of the trim members when a hollow end of said one trim member and a mating hollow end of said another trim member are each placed over a portion of said insert, abutted and closed to cover said insert from view;

the trim members being formed of a series of connected panels including a flattened wall contacting panel and a flattened ceiling contacting panel joined by a back panel, one of said wall or ceiling connecting panels having a means for hinging at its extremity opposite where said one wall or ceiling panel is joined with said back panel, said means for hinging being hinged to a decorative front panel having an edge, the edge of said decorative front panel having a releasable means for holding to a shaped extension of the other of said one wall or ceiling contacting panel when the trim member is in the closed position; and, the insertable splice member having a portion adapted to contact and receive support from the back panel inside any trim member, said member having supporting extension projecting toward and in supporting contact with a portion of the decorative front panel intermediate the means for hinging and the means for holding.

29. In a room partition wall trim cap assembly for trimming the junction between wall panels and ceiling and continuing the trim along one wall, through a corner and along the other wall, the combination of an elongated hollow ceiling trim member for each wall of the corner, said trim member having at least a flat ceiling contact panel and a flat wall contact panel in right angle relation to each other, the ceiling trim member further having a pivotable decorative front panel, said decorative panel being pivotable between an open position and a closed position and being visible to trim the junction when the contact panels are mounted in contact with a respective ceiling and wall;

a corner cap junction member having a hollow body with like right angled arms, said body being adapted to mount in the corner with a flat ceiling contact surface extending along each arm and a flat wall contact surface extending along each arm, said flat ceiling and wall contact surfaces being connected by a decorative front surface extending along each arm, said surfaces terminating at an abutment edge beyond which extends a trim member insert shaped to fit inside the hollow end of a trim member in at least partial support when a ceiling trim member is placed over said insert with its end in contact with said abutment edge, one for each arm, said abutment edge being offset corresponding to the thickness of the respective trim member decorative panel to form an neat even joint around the corner from a ceiling trim member on said one wall through said corner cap member to a ceiling trim member on said other wall when said assembly is mounted for trimming;

the trim members being formed of a series of connected panels including the flattened wall contacting panel and the flattened ceiling contacting panel joined by a back panel, one of said wall or ceiling connecting panels having a means for hinging at its extremity opposite where said one wall or ceiling panel is joined with said back panel, said means for hinging being hinged to the decorative front panel having an edge, the edge of said decorative front panel having a releasable means for holding to a shaped extension of the other of said one wall or ceiling contacting panel when the trim member is in the closed position; and, the corner cap junction member is formed from plastic and at least one trim member is shaped from coextruded plastic of one flexibility wherein the means for hinging is integrally formed in coextrusion of plastic having a greater flexibility than the flexibility of the trim member proper.

30. In a room partition wall trim cap assembly for trimming the junction between wall panels and ceiling, the combination of at least two elongated hollow ceiling trim members each being openable and closeable between a closed position and an open position, and at least one insertable ceiling trim splice member which in at least partial supporting contact fits into a hollow end of each of two of said trim members to form a neat butt joint between one of the trim members and another of the trim members when a hollow end of said one trim member and a mating hollow end of said another trim member are each placed over a portion of said insert, abutted and closed to cover said insert from view;

the trim members being formed of a series of connected panels including a flattened wall contacting panel and a flattened ceiling contacting panel joined by a back panel, one of said wall or ceiling connecting panels having a means for hinging at its extremity opposite where said one wall or ceiling panel is joined with said back panel, said means for hinging being hinged to a decorative front panel having an edge, the edge of said decorative front panel having a releasable means for holding to a shaped extension of the other of said one wall or ceiling contacting panel when the trim member is in the closed position; and, the splice member is formed from plastic and the hollow ceiling trim member is shaped from coextruded plastic of one flexibility wherein the means for hinging is integrally formed in coextrusion of plastic having a greater flexibility than the flexibility of the trim member proper.

31. In a room partition wall trim cap assembly for trimming the junction between wall panels and ceiling and continuing the trim along one wall, through a corner and along the other wall, the combination of an elongated hollow ceiling trim member for each wall of the corner, said trim member having at least a flat ceiling contact panel and a flat wall contact panel in right angle relation to each other and separated by a panel angularly connected therebetween, the ceiling trim member further having a pivotable decorative front panel spaced apart from said back panel and connected to the ceiling contacting panel by means for hinging and having in opposite location releasable means for holding to said wall contacting panel, said decorative panel being pivotable between an open position and a closed position and being visible to trim the junction when the contact panels are mounted in contact with a respective ceiling and wall;

a corner cap junction member having a hollow body with like right angled arms, said body being adapted to mount in the corner with a flat ceiling contact surface extending along each arm and a flat wall contact surface extending along each arm, said flat ceiling and wall contact surfaces being connected by a decorative front surface extending along each arm, said surfaces terminating at an abutment edge beyond which extends a trim member insert shaped to fit inside the hollow end of a trim member in at least partial support when a ceiling trim member is placed over said insert with its end in contact with said abutment edge, one for each arm, said abutment edge being offset corresponding to the thickness of the respective trim member decorative panel to form an neat even joint around the corner from a ceiling trim member on said one wall through said corner cap member to a ceiling trim member on said other wall when said assembly is mounted for trimming;

the assembly further including at least one insertable ceiling trim splice member which in at least partial supporting contact fits into a hollow end of each of two abutting sections of said elongated hollow ceiling trim member to form a neat butt joint therein with the splice member being located partially in the end of one abutting section and partially in the mating abutting section wherein the insertable splice member is hidden from view with the decorative front panel of each abutting section closed; and, the insertable splice member has a portion adapted to contact and receive support from the back panels of the abutting sections of the hollow ceiling trim member, said insertable splice member having supporting extension toward and in supporting contact with a portion of the decorative front panel of each of the two abutting hollow ceiling trim members adjacent said butt joint, between the means for hinging and the releasable means for holding.

32. In a wall partition chair rail trim assembly the combination of at least two elongated hollow chair rail trim members each having a pivotable decorative panel pivotable between an open position for installation and a closed position for use, and at least one chair rail splice member which in supporting contact fits into a hollow end of each of two of said chair rails to form a neat butt joint between one of the chair rail trim members and another of the chair rail trim members when a hollow end of said one chair rail trim member and a mating hollow end of said another chair rail trim member are each placed over a portion of said splice member and abutted to cover said splice member insert from view;

the chair rail trim members further comprising a formed wall enclosing the hollow and including a flat back panel for mounting against a wall, the formed wall continuing away from the back panel through a change of direction defining one end of said back panel to form a decorative chair bumper spaced away from the back panel and terminating at a means for releasably holding a pivotable panel, said wall continuing from the other end of said back panel, defined by another change of direction, to a means for pivoting connected to the pivotable decorative panel, said pivotable decorative panel having an exposed edge engageable by the means for releasably holding and being releasable to the open position for installation or removal; and, the splice member has at least a portion adapted to contact and receive positioning support from the back panel inside any chair rail trim member, said splice member further projecting toward and in supporting contact with at least a portion of said pivotable decorative panel.

* * * * *

UNITED STATES PATENT AND TRADEMARK OFFICE

CERTIFICATE OF CORRECTION

PATENT NO. : 5,001,877

DATED : March 26, 1991

INVENTOR(S) : Troy C. Edwards

It is certified that error appears in the above-identified patent and that said Letters Patent is hereby corrected as shown below:

Col. 8, line 16, after "panel", insert --38--

Col. 20, lines 19-25, Correct Claim 6 of the issued patent to read as follows:

--6. In a room partition wall trim cap assembly for trimming the junction between wall panels and ceiling, the combination of at least two elongated hollow ceiling trim members each being openable and closeable between a closed position and an open position, and at least one insertable ceiling trim splice member which in at least partial supporting contact fits into a hollow end of each of two of said trim members to form a neat butt joint between one of the trim members and another of the trim members when a hollow end of said one trim member and a mating hollow end of said another trim member are each placed over a portion of said insert, abutted and closed to cover said insert from view;

the trim members being formed of a series of connected panels including a flattened wall contacting panel and a flattened ceiling contacting panel joined by a back panel, one

UNITED STATES PATENT AND TRADEMARK OFFICE

CERTIFICATE OF CORRECTION

PATENT NO. : 5,001,877

DATED : March 26, 1991

INVENTOR(S) : Troy C. Edwards

It is certified that error appears in the above-identified patent and that said Letters Patent is hereby corrected as shown below:

of said wall or ceiling connecting panels having a means for hinging at its extremity opposite where said one wall or ceiling panel is joined with said back panel, said means for hinging being hinged to a decorative front panel having an edge, the edge of said decorative front panel having a releasable means for holding to a shaped extension of the other of said one wall or ceiling contacting panel when the trim member is in the closed position; and, the insertable splice member has a portion adapted to contact and receive support from the back panel inside any trim member, said member having supporting extension projecting toward and in supporting contact with a portion of the decorative front panel intermediate the means for hinging and the means for holding.--

Signed and Sealed this

Eighth Day of December, 1992

*Attest:*

DOUGLAS B. COMER

*Attesting Officer*

*Acting Commissioner of Patents and Trademarks*